US008999015B2

(12) United States Patent
Bonner et al.

(10) Patent No.: US 8,999,015 B2
(45) **Date of Patent: *Apr. 7, 2015**

(54) APPARATUS FOR UPGRADING COAL AND METHOD OF USING SAME

(71) Applicant: SynCoal Solutions Inc., Centennial, CO (US)

(72) Inventors: Harry E. Bonner, Sheridan, WY (US); Roger B. Malmquist, Butte, MT (US); Ray W. Sheldon, Huntley, MT (US)

(73) Assignee: Specialty Applications of Wyoming, LLC, Sheridan, WY (US)

( * ) Notice: Subject to any disclaimer, the term of this patent is extended or adjusted under 35 U.S.C. 154(b) by 132 days.

This patent is subject to a terminal disclaimer.

(21) Appl. No.: 13/871,984

(22) Filed: Apr. 26, 2013

(65) Prior Publication Data

US 2014/0182196 A1 Jul. 3, 2014

Related U.S. Application Data

(63) Continuation-in-part of application No. 13/732,409, filed on Jan. 1, 2013, now Pat. No. 8,671,586.

(51) Int. Cl.

| | |
|---|---|
| ***C10L 5/00*** | (2006.01) |
| ***F26B 25/00*** | (2006.01) |
| ***F26B 17/14*** | (2006.01) |
| *C10L 5/04* | (2006.01) |
| *C10L 9/08* | (2006.01) |

(52) U.S. Cl.

CPC ..... *F26B 25/002* (2013.01); *C10L 5/04* (2013.01); *C10L 9/08* (2013.01); *F26B 17/1416* (2013.01); *C10L 2290/06* (2013.01); *C10L 2290/08* (2013.01)

(58) Field of Classification Search

CPC ..... F26B 25/002; F26B 17/1416; C10L 5/04; C10L 9/08; C10L 2290/06; C10L 2290/08

USPC ..... 44/629

See application file for complete search history.

(56) References Cited

U.S. PATENT DOCUMENTS

| | | | |
|---|---|---|---|
| 1,568,738 | A | 1/1926 | Jones |
| 1,623,553 | A | 4/1927 | Randolph |
| 2,187,799 | A | 1/1940 | Baughman |
| 2,417,399 | A | 3/1947 | Evans et al. |
| 3,013,773 | A | 5/1962 | Dunkle |
| 3,800,508 | A | 4/1974 | Zenz |
| 4,043,763 | A | 8/1977 | Norman et al. |
| 4,255,403 | A | 3/1981 | Mayer et al. |
| 4,725,337 | A | 2/1988 | Greene |
| 4,750,913 | A | 6/1988 | Siddoway |

(Continued)

*Primary Examiner* — Cephia D Toomer

(74) *Attorney, Agent, or Firm* — Antoinette M. Tease

(57) ABSTRACT

An apparatus for upgrading coal comprising a baffle tower, inlet and exhaust plenums, and one or more cooling augers. The baffle tower comprises a plurality of alternating rows of inverted v-shaped inlet and outlet baffles. The inlet and outlet plenums are affixed to side walls of the baffle tower. Process gas enters the baffle tower from the inlet plenum via baffle holes in the side wall and dries the coal in the baffle tower. Process exhaust gas exits the baffle tower into the exhaust plenum via baffle holes in a different side wall of the baffle tower. Coal that enters the baffle tower descends by gravity downward through the baffle tower and enters a cooling auger, where the dried coal from the baffle tower is mixed with non-dried coal. A method of using the apparatus described above to upgrade coal.

17 Claims, 24 Drawing Sheets

(56) References Cited

U.S. PATENT DOCUMENTS

| | | | | |
|---|---|---|---|---|
| 4,810,258 | A | 3/1989 | Greene | |
| 5,137,539 | A | 8/1992 | Bowling | |
| 6,213,029 | B1 | 4/2001 | Potter et al. | |
| 8,371,041 | B2 * | 2/2013 | Bonner et al. | 34/505 |

* cited by examiner

APPARATUS FOR UPGRADING COAL AND METHOD OF USING SAME

CROSS-REFERENCE TO RELATED APPLICATION

This application is a continuation-in-part of U.S. patent application Ser. No. 13/732,409 filed on Jan. 1, 2013, which is a divisional of U.S. patent application Ser. No. 12/495,775 filed on Jun. 30, 2009. The latter application is a continuation-in-part of U.S. patent application Ser. No. 11/652,180 filed on Jan. 11, 2007 and U.S. patent application Ser. No. 11/652,194 filed on Jan. 11, 2007. The contents of these applications are incorporated herein by reference.

BACKGROUND OF THE INVENTION

1. Field of the Invention

The present invention relates generally to the energy field, and more specifically, to a processor for drying and heating coal and mixing it with cool (non-dried) coal.

2. Description of the Related Art

Coal is increasingly in demand as an immediately available source of incremental energy to fuel the world's growing energy needs. Coal has and will continue to increase in price as all other sources of energy, particularly petroleum, are depleted and increase in value. Both the US domestic and global coal markets are changing as existing high-grade coal sources are depleted. As a result, utility and other industrial users of coal are spending large amounts of capital to refit existing plants or build new plants designed to burn lower quality (rank) coals, or paying increasingly higher amounts for high-grade compliance coals that better meet the optimal operational specifications.

Coal upgrading (converting a low-rank coal to a higher rank coal) provides viable access to the great resources of lower rank coals available in the United States and other countries and provides a low-cost alternative to either extensive modifications needed to handle and combust the lower rank coals, or a reduction in the productive capacity of the existing power plant facilities suffered when the lower rank coals are used without alteration.

Under the right conditions of temperature and pressure, organic matter in nature undergoes a metamorphous, or coalification, process as peat is gradually converted to lignite, sub-bituminous coal, bituminous coal, and finally to anthracite. This transition—in which the rank of the coal increases—is characterized by a decrease in the moisture and oxygen content of the coal and an increase in the carbon-to-hydrogen ratio. Lignite and sub-bituminous coals have not been as thoroughly metamorphosed and typically have high inherent (bound) moisture and oxygen contents and, correspondingly, produce less combustive heat energy per ton of coal.

All coals were deposited in marine environments where non-combustible impurities such as clay, sand, and other minerals are interbedded with the organic material and form ash in the combustion process, contributing to deposit formation on the system heat exchange surfaces. Additionally, some combustible materials such as pyrite are deposited within the coal by a secondary geologic process. It is these impurities that are responsible for the production of much of the sulfur dioxide, particulates and other pollutants when burning coals. These imparities exist in all ranks of coals, requiring expensive pollution controls technologies to be employed to reduce the level of emissions in the released flue gas to be compliant with the regulatory mandates.

The combustion system designed for a particular coal will not work as effectively for a coal of dissimilar rank or quality. For a specific heat release rate, the furnace volume required for combustion decreases with increasing rank. Because each combustion system performs well when consuming a coal with specific rank and quality (ash content) characteristics, firing with a coal that does not conform to the design fuel typically results in reducing the efficiency of the system. As the concentration of the mineral impurities (or ash content) increases, the operational characteristics of the combustion system are detrimentally affected. Additionally, the system produces increasing quantities of hazardous pollutants that must be captured to prevent release into the environment.

Coal drying technologies raise the apparent rank of the feed coal processed by reducing the moisture content of the coal, which results in more heat produced per ton of dried—or upgraded—coal. Certain processes also reduce oxygen and volatile content. This is generally accomplished using a system in which the coal is dried with an inert gas (i.e., a gas with no oxygen concentration) or a gas having an acceptably low concentration of oxygen.

Coal cleaning processes reduce the concentration of mineral impurities in the processed coal. In the ideal case, only mineral matter would be removed from the organic material, leaving only organic material. The efficiency of the cleaning process is dependent on the extent to which mineral matter is liberated (physically separated into discrete particles that are predominantly mineral matter or organic material) from the organic material. In practice, mineral particles will not be predominately liberated from the organic material particularly in the lower rank coals. As such, it is not possible to completely separate all of the mineral matter from the organic material without losing organic material also. Cleaning is not typically applied to low-rank coals because of the relative abundance and low value of the native or unprocessed low-rank coals and because simply crushing a low-rank coal does not effectively liberate mineral matter from the organic material.

The American Society of Testing and Materials provides procedures for analyzing coal samples. Moisture content is defined as the loss in mass of a sample when heated to 104° C. Volatile content is defined as the loss in mass of a sample when heated to 950° C. in the absence of air, less the moisture content. The ash content is defined as the residue remaining alter igniting a sample at 750° C. in air. As a sample is heated, moisture is evolved from the sample concurrent with an increase in the temperature of the coal remaining. If the sample is allowed to maintain an equilibrium between the temperature of the coal and the moisture content, all of the moisture would be removed when the coal residue has a temperature of 104° C. As the coal is heated further in the absence of oxygen, volatile organic compounds (VOCs), a regulated hazardous air pollutant, are evolved.

Numerous schemes have been devised to upgrade—or dry—low-rank coals. These attempts can be divided into three levels of effort: partial drying, complete drying, and complete drying with additional volatile content removed. As noted above, the processing temperature of the dual dried product will typically increase in relation to the extent of processing; that is, the final product temperature of a partially dried coal will be lower than would be expected for the final product temperature of the same coal dried completely. The temperature of the process gas used by many processes has historically been elevated to minimize the contact time between the coal and the process gas required to dry the coal; however, this in turn causes VOCs to be stripped from the coal particles as the outside portion of the particles will tend to be heated to a higher temperature than the inside of the particles. A high-temperature process gas may not be used in driers with relatively short drying times if the elimination of VOCs is a desired result.

Numerous methods have been devised to heat the coal: direct contact with a relatively inert gas, indirect contact with a heated fluid medium, hot oil baths; etc. Some processes operate under vacuum while some operate at elevated pressure. Regardless of the process, the dried product qualities are relatively similar, and the costs are prohibitive. To be economically attractive, the total processing cost, including the costs of the feed coal and the environmental controls, cannot exceed the cost of an available higher rank coal delivered to the customer.

The dried product resulting from the majority, if not all, of the conventional processes have four attributes that reduce the value of the dried product. The dried product is typically dusty, prone to moisture re-absorption, prone to spontaneous ignition, and has a reduced bulk density. These characteristics require special attention relating to handling, shipping and storage.

With few exceptions, notably indirectly heated screw augers and rotary kiln drying, many of the conventional processes require a sized feed with the largest particle size or the smallest particle size limited to accommodate processing constraints. Fluidized bed and vibrating fluidized bed processes, while efficient for contacting the drying media with the coal, do not tolerate fines due to elutriation. Fluidized beds do not operate efficiently when processing particles with a wide size range; oversized material requires increased compressive power, and fine material is elutriated from the fluidized bed processor.

The inability in produce a dried product at an acceptable cost has prevented these processes from gaining reasonable commercial acceptability. Capital and operating costs, together with product quality issues (e.g., the coal is dusty, prone to spontaneous ignition, etc.), have resulted in the perception that coal upgrading should not be included in the discussion relating to increasing available high-quality, low-cost fuel supplies, which may extend the life and expand the productive capacity of some combustion systems while reducing the uncontrolled emission inventory.

Further, as the extent, or intensity, of processing increases (final product temperature increases), the environmental processing costs increase because the evolution of VOCs demands pollution control systems, and the materials of construction require additional capital to accommodate the elevated temperatures and corrosive environment.

Disregarding the cost of feed coal and the cost of heat energy, operating costs for coal upgrading have historically been quite high. High compressive energy costs are typically associated with fluid and vibrating fluid beds. High maintenance costs are typically associated with higher temperatures and more corrosive environments. High labor costs are usually a function of maintenance requirements and complicated process configurations. All of these issues combine to increase process controls and supervision costs.

The dried product from the conventional processes varies in the qualities desired for a cleaning process. A coarser product is more amenable to the cleaning system because separation is a function of particle size, shape and density. This requires the coal to be sized for delivery to the cleaning system and precludes cleaning the very small sizes. Fluid bed product is not a particularly good feed for cleaning systems because a large portion of the product particles are too small to be cleaned efficiently.

Product cooling has not been given the level of consideration warranted by dried coal properties. Regulations for coal transported in marine vessels requires the coal not exceed 140° F. to avoid fires on the vessel. Cooling the dried product represents a significant cost, and many of the unit operations attempted have not been particularly effective for reducing the temperature of the dried product to acceptable temperatures for transporting, handling and storing the dried product.

Producing a dried coal that has consistent qualities throughout the size range of the particles with five percent (5%) of the moisture content that was present in the parent or feed coal while limiting the evolution of VOCs to negligible levels would be highly desirable. This would limit the environmental processing to particulate considerations. Processing the feed coal by direct contact with a relatively inert gas at a temperature of about 700° F. would allow flue gas from industrial or utility systems to be used while minimizing costs related to materials of construction and reducing process gas volumes to be handled.

BRIEF SUMMARY OF THE INVENTION

The present invention is an apparatus for upgrading coal comprising a baffle tower, an inlet plenum, an exhaust plenum, and one or more conveyance devices; wherein the baffle tower comprises one or more side walls; wherein each side wall has an outer face; wherein a portion of the coal enters the baffle tower; wherein the baffle tower comprises a plurality of alternating tows of inverted v-shaped inlet baffles and inverted v-shaped outlet baffles; wherein all of the rows of inlet baffles are parallel to one another, and all of the rows of outlet baffles are parallel to one another; wherein the rows of inlet baffles are perpendicular to the rows of outlet baffles; wherein the inlet plenum is affixed to the outer face of one of the side walls of the baffle tower; wherein the exhaust plenum is affixed to the outer face of one of the side walls of the baffle tower; wherein process gas enters the baffle tower from the inlet plenum via baffle holes in one of the side walls of the baffle tower; wherein the process gas that enters the baffle tower from the inlet plenum dries the coal that enters the baffle tower and becomes process exhaust gas; wherein the process exhaust gas exits the baffle tower into the exhaust plenum via baffle holes in one of the other side walls of the baffle tower; and wherein the coal that enters the baffle tower descends by gravity downward through the baffle tower and enters a conveyance devices.

In a preferred embodiment, the present invention is an apparatus for upgrading coal comprising at least two segmented units, each segmented unit comprising a processor segment, an inlet plenum, and an exhaust plenum; wherein the processor segment comprises a plurality of alternating rows of inverted v-shaped inlet baffles and inverted v-shaped outlet baffles; wherein all of the rows of inlet baffles are parallel to one another, and all of the rows of outlet baffles are parallel to one another; wherein the rows of inlet baffles are perpendicular to the rows of outlet baffles; wherein the inlet plenum is connected to an outer face of a first side wall of the processor segment; wherein the exhaust plenum is connected to an outer face of a second side wall of the processor segment; wherein process gas enters the processor segment from the inlet plenum via baffle holes in the first side wall of the processor segment; wherein the process gas that enters the processor segment from the inlet plenum dries coal that enters the processor segment and becomes exhaust gas; wherein the exhaust gas exits the processor segment into the exhaust plenum via baffle holes in the second side wall of the processor segment; and wherein the coal that enters the processor segment descends by gravity downward through the processor segment. In another preferred embodiment, the segmented units are stacked vertically, and there is a top segmented unit and a bottom segmented unit.

In a preferred embodiment, the process gas enters through the inlet plenum of the top segmented unit and exhaust gas exits through the exhaust plenum of the top segmented unit. In another preferred embodiment, the process gas enters through the inlet plenum of the bottom segmented unit and exhaust gas exits through the exhaust plenum of the bottom segmented unit. In yet another preferred embodiment, the process gas enters through the inlet plenum of the top segmented unit and exhaust gas exits through the exhaust plenum of the bottom segmented unit. In yet another preferred embodiment, the process gas enters through the inlet plenum of the bottom segmented unit and exhaust gas exits through the exhaust plenum of the top segmented unit.

In at preferred embodiment, the process gas enters through the inlet plenum of the top segmented unit and exhaust gas exits through multiple exhaust plenums. In another preferred embodiment, the process gas enters through the inlet plenum of the bottom segmented unit and exhaust gas exits through multiple exhaust plenums.

In a preferred embodiment, the inlet plenum of the top segmented unit comprises a plenum segment expansion joint and a spool connector, and the inlet plenum is connected to the first side wall of the processor segment of the top segmented unit with a plenum-to-processor expansion joint. In another preferred embodiment, the exhaust plenum of the top segmented unit comprises a plenum segment expansion joint and a spool connector, and the exhaust plenum is connected to the second side wall of the processor segment of the top segmented unit with a plenum-to-processor expansion joint.

In a preferred embodiment, the inlet plenum of the top segmented unit has a depth, and the inlet plenum of the bottom segmented unit has a depth, and the depth of the inlet plenum of the top segmented unit is greater than the depth of the inlet plenum of the bottom segmented unit. In another preferred embodiment, the exhaust plenum of the top segmented unit has a depth, and the exhaust plenum of the bottom segmented unit has a depth, and the depth of the exhaust plenum of the top segmented unit is greater than the depth of the exhaust plenum of the bottom segmented unit.

In a preferred embodiment, the inlet plenum has a cross-sectional flow area, the process gas flows into the inlet plenum at an inlet plenum gas flow rate, and the cross-sectional flow area of the inlet plenum is proportional to the inlet plenum gas flow rate. In another preferred embodiment, the exhaust plenum has a cross-sectional flow area, the exhaust gas flows into the exhaust plenum at an exhaust plenum gas flow rate, and the cross-sectional flow area of the exhaust plenum is proportional to the exhaust plenum gas flow rate.

In a preferred embodiment, the processor segment of the top segmented unit comprises a processor expansion joint that connects the processor segment of the top segmented unit to a processor segment of a segmented unit directly beneath the top segmented unit. In another preferred embodiment, the processor segment expansion joint comprises a particulate retainer and a flexible gas-tight seal.

REFERENCE NUMBERS

Figure 1:
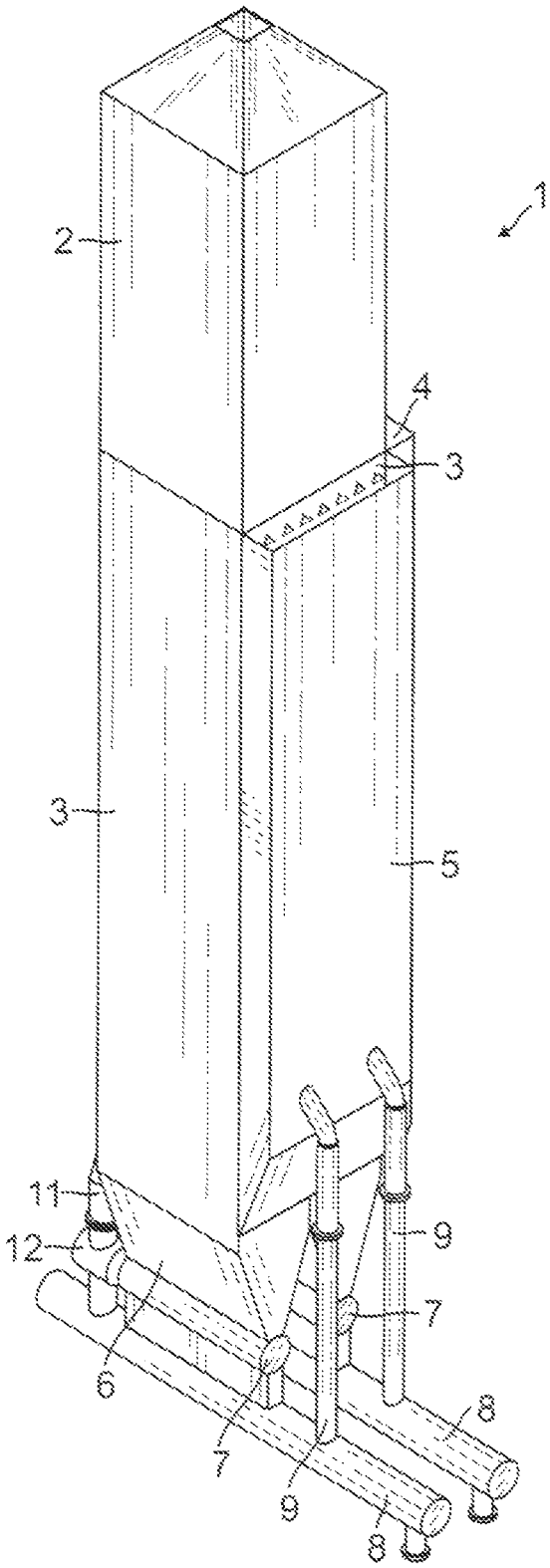
FIG. 1 is a first perspective view of the processor of the present invention.

1 Processor
2 Coal intake bin
3 Baffle tower
4 Inlet plenum
5 Exhaust plenum
6 Spool discharge
7 First flow regulator
8 Cooling auger
9 Exhaust tubing
10 Coal intake tubing
11 Splitter
12 Second flow regulator
13 Coal discharge tubing
14 Solid side wall (of baffle tower)
15 Side wall with baffle holes (of baffle tower)
16 Baffle hole
17 Aperture (in top of coal intake bin)
18 Gap (between aperture and coal intake tubing)
19 Ceiling (of coal intake bin)
20 Side wall (of coal intake bin)
21 Baffle
**21*a*** Half baffle
22 Chamber (of spool discharge)
23 Open bottom end (of spool discharge)
24 Slat (in spool discharge)
25 Bottom edge (of exhaust plenum)
26 Edge (of spool discharge)
27 Top corner (of spool discharge)
28 Top edge (of spool discharge)
29 Top edge (of slat)
30 Bottom edge (of slat)
31 Sloped surface (of lower portion of exhaust plenum)
32 Process gas flow
33 Exhaust gas flow
34 first modular segment
35 Second modular segment
36 Third modular segment
37 First inlet plenum
38 First exhaust plenum
39 First processor segment
40 Second inlet plenum
41 Second exhaust plenum
42 Second processor segment
43 Third inlet plenum
44 Third exhaust plenum
45 Third processor segment
46 Plenum segment expansion joint
47 First plenum segment spool connector
48 Plenum to processor segment expansion joint
49 Processor segment expansion joint
50 Second plenum segment spool connector
51 Process gas, first portion
52 Process gas, second portion
53 Process gas, third portion
54 Exhaust gas, first portion
55 Exhaust gas, second portion
57 High temperature processor exhaust port
58 Upper processor segment
59 Lower processor segment
60 Particulate retainer
61 Gas-tight seal
62 Weld points
63 Accordion-folded metal strip
64 Bolts
65 Gaskets
66 Nuts

DETAILED DESCRIPTION OF INVENTION

The present invention provides a platform for drying coal economically while reducing the potential for liberating VOCs from the coal, cooling the product to temperatures acceptable for transportation and storage, and enhancing the potential for effectively and efficiently cleaning the product. A significant advantage of the present invention is that it does not add to the uncontrolled emission of the host facility, with the exception of emissions due to material (coal) handling in connection with the conveyors feeding the coal to and from the processor. From the time the coal enters the coal intake bin to the time is leaves the cooling augers, it is inside a completely closed system.

The three main components of the present invention are: (1) a cooling coal extraction system that allows a portion of the feed coal to be extracted and used in the cooling process; (2) a drying component system that heats and dehydrates the coal; and (3) a cooling component system that cools the hot dry coal to a desired final temperature.

Although the present invention is not limited to any particular size of coal pieces, in the preferred embodiment, the coal pieces would have a top size of two inches (i.e., the largest particle in the feed would pass through a two-inch opening in a screen). The use of larger coal pieces would require adjustment of the baffle spacing and size described herein.

Although not part of the present invention, separate systems would be used to deliver coal to and accept product from the present invention. The rate of coal feed to the present invention would be regulated and controlled to closely match the operational requirements of the present invention. The process gas that is used in connection with the present invention would have an acceptable oxygen content at an appropriate temperature to facilitate the operation of the processor, and the exhaust gas exiting the processor would be delivered to suitable handling equipment.

The cooling coal extraction system of the present invention comprises coal intake tubing 10 that extracts a minor fraction from the coal feed stream for use in cooling the hot dried coal. The major fraction, or the balance of the feed coal stream, is delivered to the drying component system. For a typical application, about one (1) pound of cooling coal (the "minor fraction") would be required for ten (10) pounds of hot (dried) coal (the "major fraction").

The drying component system comprises the coal intake bin, the baffle tower, the spool discharge, and the intake and exhaust plenums. In a preferred embodiment, the coal intake bin, the baffle tower, and the upper part of the spool discharge all have the same horizontal cross-sectional dimensions and are positioned in a continuous rectangular vertical column with the coal intake bin positioned directly above and attached to the baffle tower and the spool discharge positioned directly below and attached to the baffle tower. The three sections may be configured to be square or rectangular in cross-section (width), or they may be wider in one horizontal dimension than the other. As illustrated in the figures, these three sections are configured to be square in cross-section. The process gas distribution or inlet plenum is configured to provide uniform distribution of the process gas through the full height and width of the baffle tower. Likewise, the process gas receiving or exhaust plenum collects process exhaust gas from the full height and breadth of the baffle tower.

The coal intake bin serves two functions. It provides a mechanism for accommodating variations in the coal feed rate (by maintaining a constant level of coal in the coal intake bin), and it also serves as a barrier to process gasses escaping through the coal feed port (or aperture 17). The level of coal in the coal intake bin is preferably maintained to provide sufficient resistance to gas flow such that process gasses are directed to the exhaust plenum (the process gasses do not exit back through the inlet plenum because the pressure of the gas in the inlet plenum exceeds the pressure of the gas in the exhaust plenum). During operation, the coal intake bin, the baffle tower and the spool discharge are all filled with coal. The bulk density of the coal in these components is approximately the same as the bulk density that would be measured in live storage conditions. For a typical sub-bituminous coal, the bulk density would be about fifty-two (52) to fifty-five (55) pounds per cubic foot.

The baffle tower is equipped with internal inverted v-shaped baffles that serve to mix the coal, distribute process gas to the coal in the baffle tower, and collect the process exhaust gas from the coal in the baffle tower. The configuration of the baffles inside the baffle tower maximizes gas-to-solids contact time, maximizes heat transfer from the process gas to the coal, and maximizes compressive energy requirements.

The rotary locks 7 provide a mechanism for metering the discharge of the hot, dried coal from, and the feed rate of coal to, the baffle tower. The flow area from the horizontal cross-section of the baffle tower is reduced by a spool discharge that directs the flow of the hot dried coal into two equal streams to accommodate flow into rotary locks that control the rate of discharge from the drying component system and deliver the hot, dried coal to the cooling component system.

The cooling component system comprises the splitter 11, the two rotary locks 12 underneath the splitter 11, and the two cooling augers 8. (Note that when the coal intake tubing 10 is full, the incoming coal will all be diverted into the coal intake bin 2 and into the baffle tower 3). Each cooling auger 8 is a dual-inlet (i.e., coal from the splitter 11 and coal from the spool discharge 6), single-outlet enclosed cooling mixer that blends the cooling coal with the hot, dried coal. A reserve of cooling coal is maintained in the coal intake tubing 10 to accommodate cooling requirements during shutdown. The cooling coal is metered to the head end of the cooling auger. The hot, dried coal is discharged into the cooling auger downstream of the cooling coal inlet through the rotary locks used to regulate the discharge of the hot, dried coal from the drying component system. The hot, dried coal is added to the cooling auger by placing the hot, dried coal onto the cooling coal and thoroughly mixing the two streams of coal. Each rotary discharge lock that is provided to meter the rate of hot, dried coal discharged from the baffle tower will require a dedicated cooling auger 8 and a dedicated cooling coal feeder (in this case, the rotary lock 12 underneath the splitter 11).

The present invention is discussed more fully below in reference to the figures:

FIG. 1 is a first perspective view of the processor of the present invention. As shown in this figure, the processor 1 comprises a coal intake bin 2, a baffle tower 3, an inlet plenum 4, an exhaust plenum 5, a spool discharge 6, and two first flow regulators 7, preferably rotary locks. In a preferred embodiment, the invention further comprises two cooling augers 8. The length of the first flow regulators 7 is preferably roughly equivalent to the width of the baffle tower 3. The exhaust plenum 5 is preferably connected by exhaust tubing 9 to the cooling augers 8. The first flow regulators 7 are situated directly underneath the spool discharge 6 and directly on top of the cooling augers 8. The first flow regulators 7 control the rate of flow of the coal through the baffle tower 3 by controlling the rate by which the coal exits the spool discharge 6 and enters the cooling augers 8.

Figure 2:
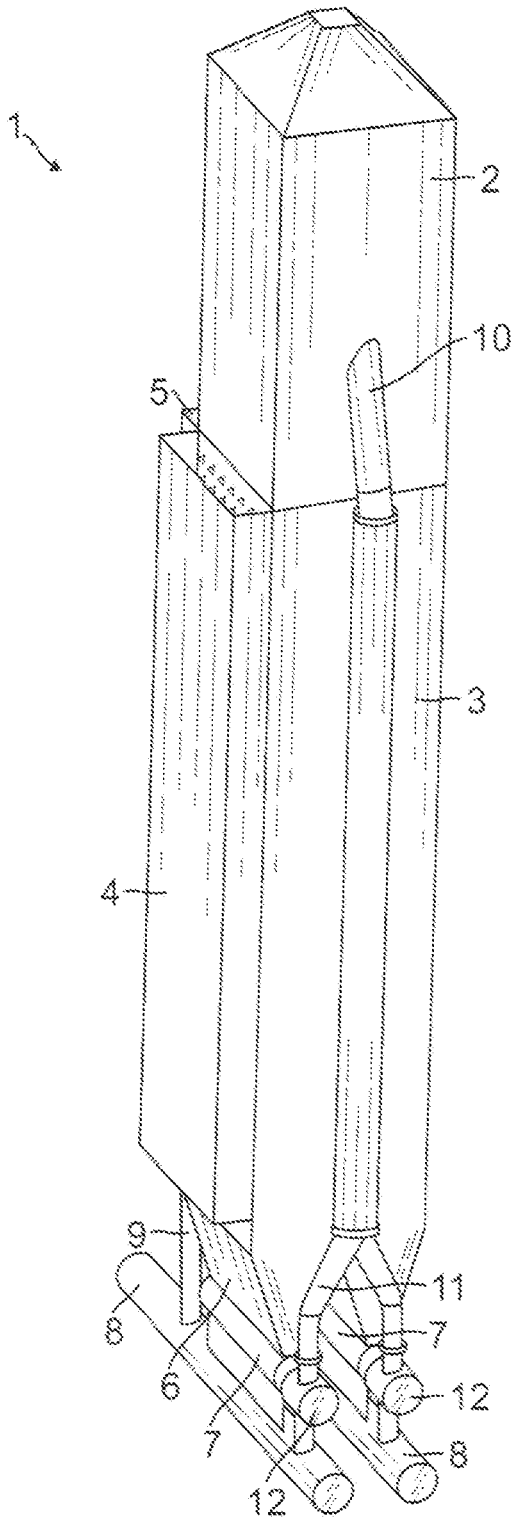
FIG. 2 is a second perspective view of the processor of the present invention.

FIG. 2 is a second perspective view of the processor of the present invention. As shown in this figure, the coal intake bin 2 includes coal intake tubing 10 that runs from inside the coal intake bin 2 (see FIGS. 5 and 6) through a side wall of the coal intake bin to the outside of the coal intake bin 2 and then runs vertically downward outside a side wall of the baffle tower 3 until it connects to a splitter 11. The coal that enters the coal intake tubing 10 passes through the splitter 11 and enters one of two second flow regulators 12, preferably rotary locks. These second flow regulators 12 discharge the coal directly into the head end of the cooling augers 8, and they control the rate at which coal coming from the coal intake tubing 10 is discharged into the cooling augers 8. The purpose of the second flow regulators 12 is to preload the cooling auger so that the hot (dried) coal may be loaded on top of it. The cooling augers 8 collect and mix coal from both the coal intake tubing 10 (the cool, unprocessed coal) and from the spool discharge 6 (the hot, dried coal) and in turn discharge the cooled, dry product onto a conveyor belt, bucket elevator or other transport mechanism via the coal discharge tubing 13.

Figure 3:
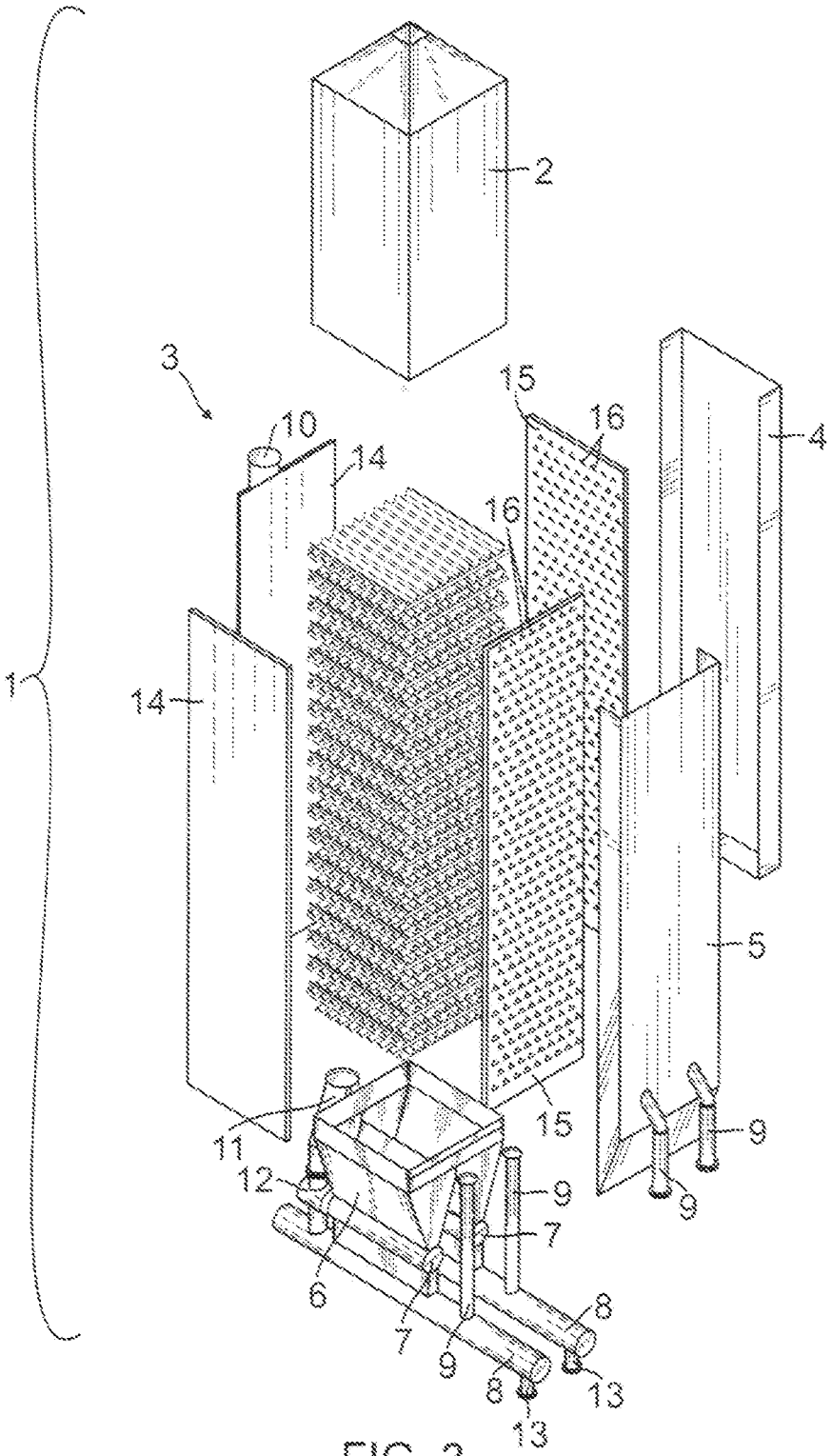
FIG. 3 is an exploded view of the processor of the present invention.

FIG. 3 is an exploded view of the processor of the present invention. This figure shows the coal intake bin 2, the inlet plenum 4, the exhaust plenum 5, the spool discharge 6, the first flow regulators 7, and the cooling augers 8. It also shows the various components of the baffle tower 3. The baffle tower 3 comprises two solid side walls 14 and two side walls 15 with baffle holes 16 that correspond in size and shape to the ends of the baffles shown in FIG. 8. This figure also shows the exhaust tubing 9 that connects the exhaust plenum 5 to the cooling augers 8, the coal intake tubing 10 that runs from the coal intake bin to the cooling augers 8, and the first and second flow regulators 11, 12, which together control the rate of flow of the hot dried coal and cool, unprocessed coal, respectively, into the cooling augers 8.

Figure 4:
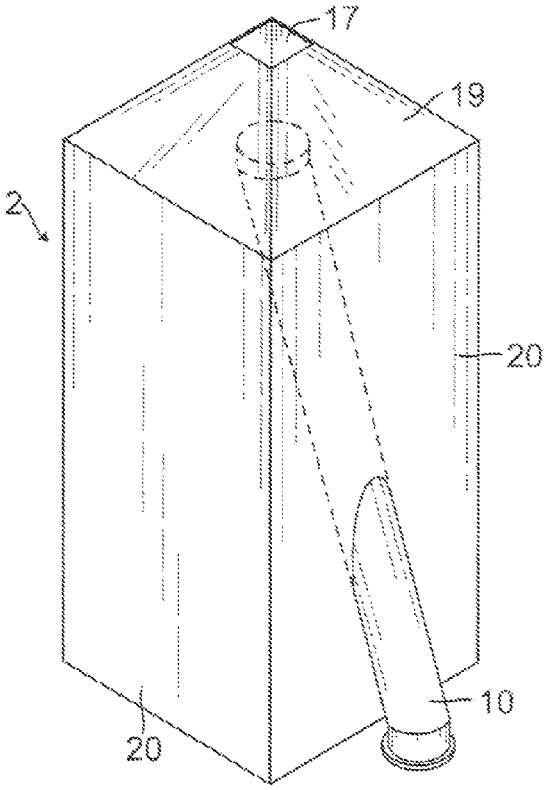
FIG. 4 is a side perspective view of the coal intake bin of the present invention.

FIG. 4 is a side perspective view of the coal intake bin of the present invention. The coal intake bin 2 is situated directly on top of the baffle tower 3, and it comprises a top aperture 17 through which coal enters the processor 1. Some of the coal will enter the coal intake tubing 10 and be metered into the cooling augers 8 via the splitter 11 and second rotary locks 12. The rest of the coal will flow through the baffle tower 3.

Figure 5:
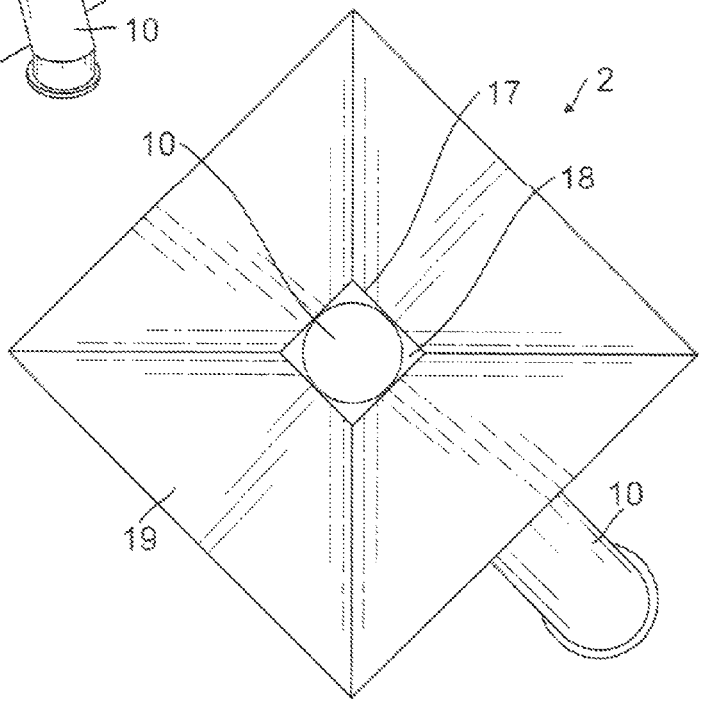
FIG. 5 is a top view of the coal intake bin of the present invention.

FIG. 5 is a top view of the coal intake bin of the present invention. As shown in this figure, the coal intake tubing 10 is centered below the aperture 17, ensuring coal will flow into the coal intake tubing 10 when coal is delivered to the processor. The rest of the coal will flow (by gravity) into the gap 18 between the aperture 17 and the coal intake tubing 10 and down into the baffle tower 3, where it will be heated and eventually discharged into the cooling augers 8.

Figure 6:
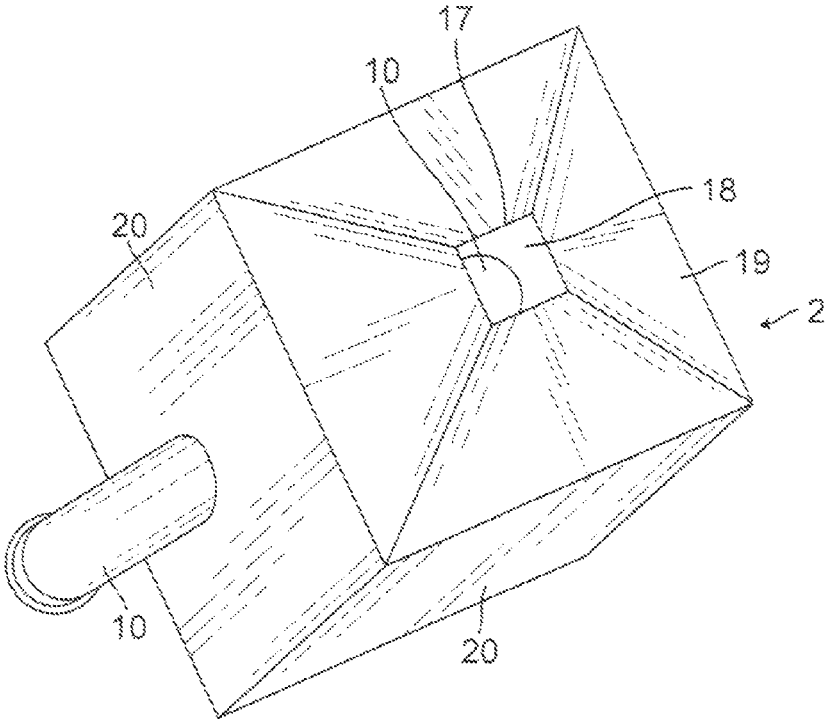
FIG. 6 is a top perspective view of the coal intake bin of the present invention.

FIG. 6 is a top perspective view of the coal intake bin of the present invention. As shown in this figure, the top of the coal intake tubing 10 is well below the point at which the coal enters the aperture 17 such that some of the coal will fall directly into the coal intake tubing 10 and some of the coal will enter the baffle tower 3. The top end of the coal intake tubing 10 is preferably centered underneath the aperture 17 in the ceiling 19 of the coal intake bin 2, and the diameter of the coal intake tubing 10 is preferably roughly the same as the width of the aperture 17, as shown in FIG. 5.

Figure 7:
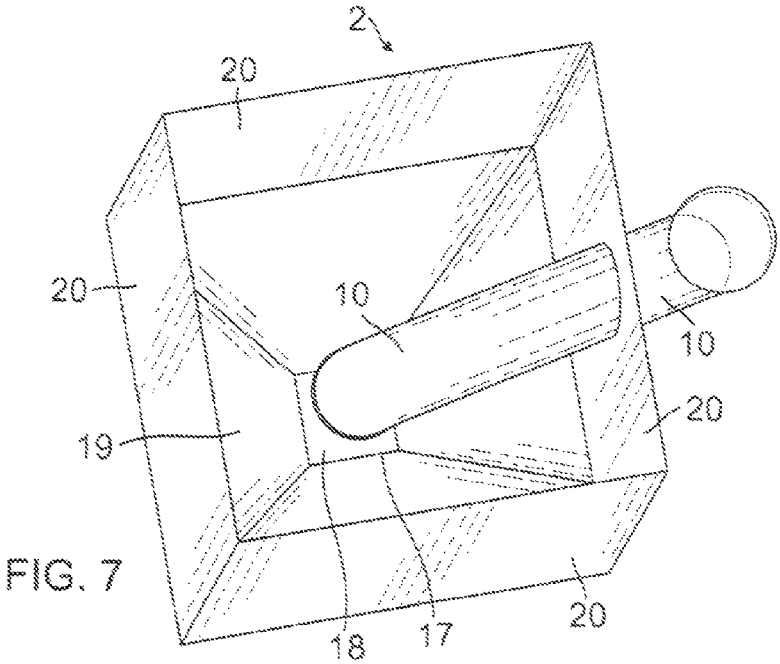
FIG. 7 is a bottom view of the coal intake bin of the present invention.

FIG. 7 is a bottom view of the coal intake bin of the present invention. As shown in this figure, the bottom of the coal intake bin 2 is open to the baffle tower 3. When the processor 1 is fully assembled, the coal intake bin 2 sits directly on top of the baffle tower 3, and the side walls 20 of the coal intake bin 2 are vertically aligned with the side walls 14, 16 of the baffle tower 3.

Figure 8:
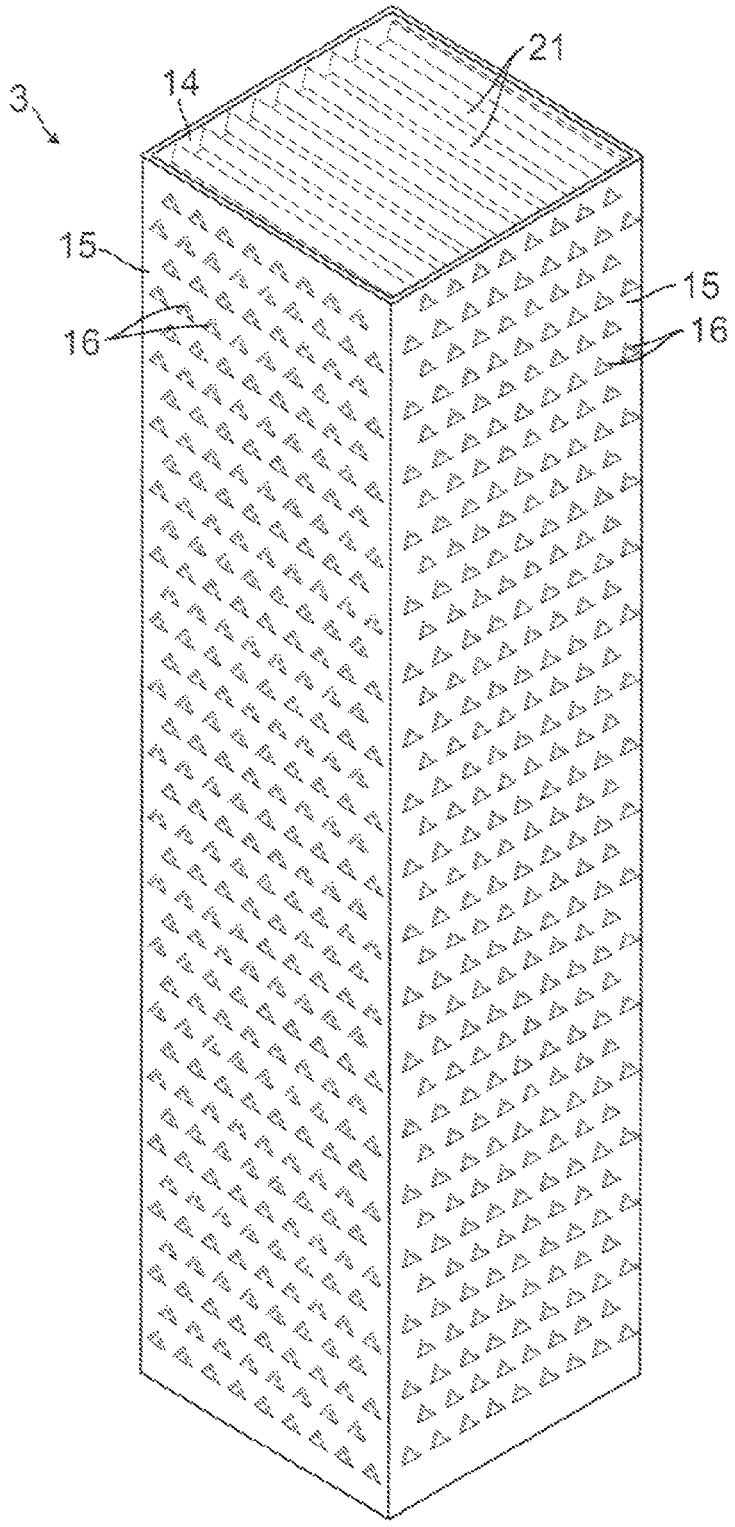
FIG. 8 is a first perspective view of the baffle tower of the present invention.

FIG. 8 is a first perspective view of the baffle tower of the present invention. The baffle tower 3 comprises two solid side walls 14 (not shown) and two side walls 15 perforated with baffle holes 16. The baffle tower 3 further comprises alternating rows of inverted v-shaped baffles 17 (see FIGS. 10 and 11). In the preferred embodiment, the baffle tower is nine (9) feet six (6) inches wide, nine (9) feet six (6) inches deep, and about forty-two (42) feet tall. The present invention is not limited to any particular number of baffles in each row nor to any particular number of rows of baffles; however, in the embodiment shown in FIG. 8, there are thirty-six (36) rows of baffle holes in one of the side walls 15 and thirty-six (36) rows of baffles holes in the other side wall 15. In this embodiment, the approximate dimension of each baffle 21 is 6.00 inches wide (at the base) and 6.43 inches tall, (from base to apex). After allowing for the thickness of the metal rod clearance between rows of baffles, each row of baffles will require about seven (7) inches of vertical head space. In this configuration, each alternate row of baffles on one side wall has either nine full baffles or eight full baffles with a half baffle 21*a* on either end of the row (see FIG. 11).

Figure 9:
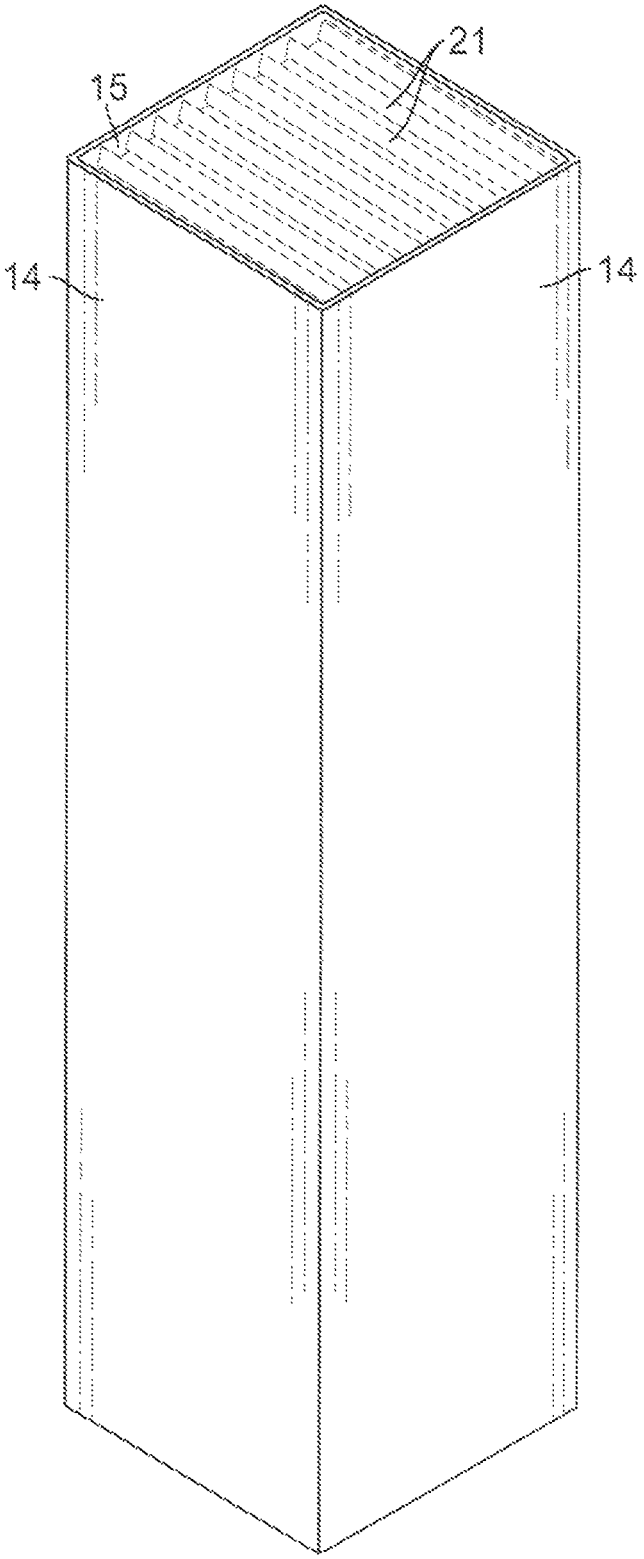
FIG. 9 is a second perspective view of the baffle tower of the present invention.

FIG. 9 is a second perspective view of the baffle tower of the present invention. This figure shows the two solid side walls 14 of the baffle tower 3. In a preferred embodiment, the two solid side walls 14 are perpendicular to one another, and the two side walls 15 with baffle holes 16 are also perpendicular to one another so that each solid side wall 14 faces a side wall 15 with baffle holes 16. The intake and exhaust plenums 4, 5 are affixed to the two side walls 15 that have the baffle holes 16, as shown in FIGS. 1 and 2.

Figure 10:
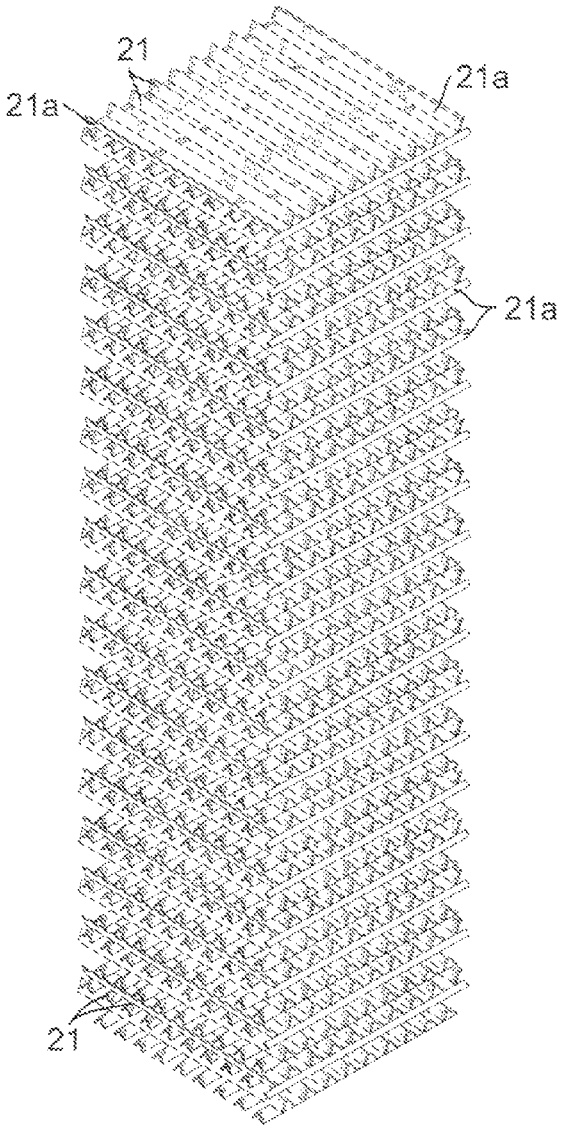
FIG. 10 is a perspective view of the baffle tower shown without the side walls.
Figure 11:
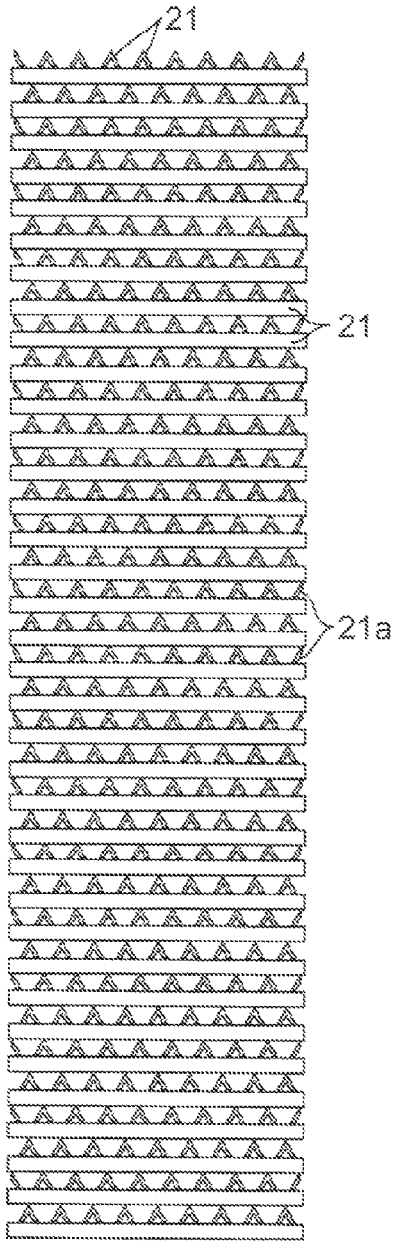
FIG. 11 is a side view of the baffle tower shown without the side walls.
Figure 21:
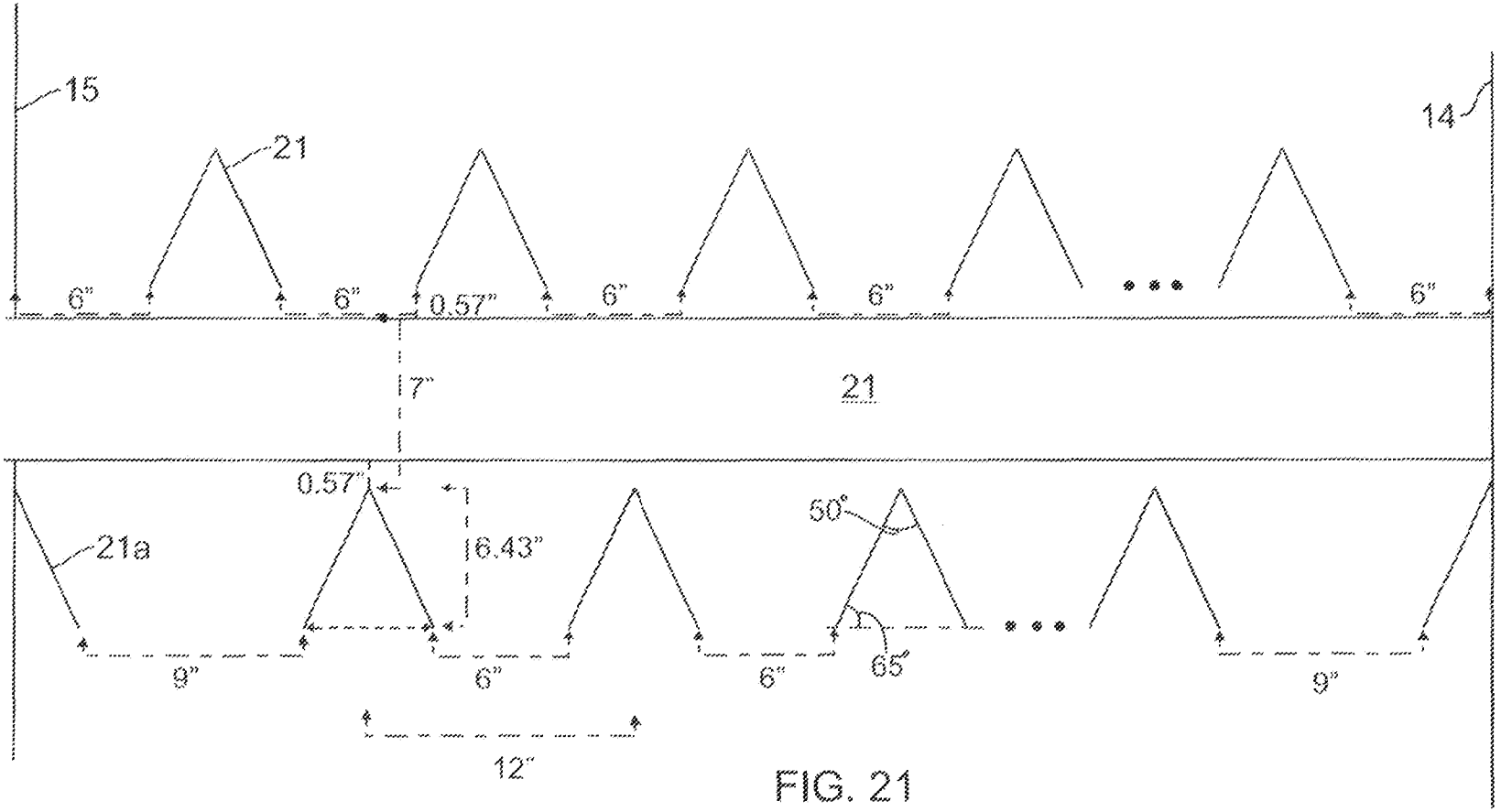
FIG. 21 is a diagram of the baffle dimensions in a preferred embodiment.

FIG. 10 is a perspective view of the baffle tower shown without the side walls. This figure illustrates the orientation of the baffles 21 inside of the baffle tower 3. In this embodiment, there is typically a space of six (6) inches between full baffles and a space of nine (9) inches between each half baffle 21*a* at the end of a row and the next adjacent full baffle 21. As shows in this figure, every other row has a half baffle 21*a* on either end of the row to allow the baffles to be staggered (as shown in FIG. 11). In a preferred embodiment, the vertical spacing between baffle rows is 0.57 inches from the apex of the lower baffle to the base of the higher baffle; this also equates to approximately seven inches from the apex of the lower baffle to the apex of the higher baffle. These dimensions are shown in FIG. 21; all of these dimensions are for illustrative purposes only and are not intended to limit the scope of the present invention. The present invention may be constructed with different baffle dimensions as long as the basic configuration described herein (and shown in the figures) is followed.

FIG. 11 is a side view of the baffle tower shown without the side walls. This figure illustrates the configuration of the ends of each baffle 21 facing one of the side walk 15 with baffle holes 16. As noted above, the location of the baffle boles 16 on the side walls 15 corresponds to the ends of the baffles 21 that are facing the side wall 15. Thus, one side wall 15 is open (via the baffle holes 16) to all of the baffles 21 that face in one direction, and the other side wall 15 is open (via the baffle holes 16) to all of the baffles 21 that face in the other direction. Each alternating row of baffles is oriented perpendicularly to the baffle row immediately above or below it.

Figure 12:
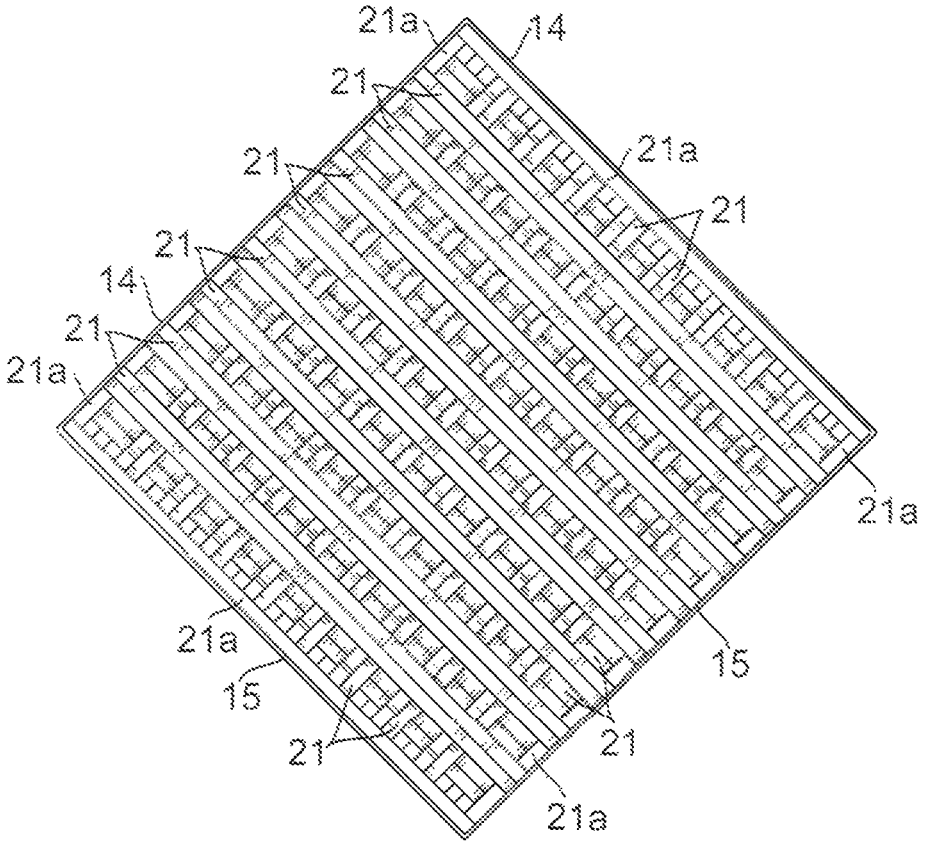
FIG. 12 is a top view of the baffle tower shown with the side walls.

FIG. 12 is a top view of the baffle tower shown with the side walls. This view illustrates the alternating orientation of the rows of the baffles 21 and half baffles 21*a* wherein every row is oriented perpendicular to the row located immediately above or below each row. It also illustrates the staggered configuration of similarly oriented baffles wherein the space between baffles in a row is situated directly in line with the baffle located in the similarly oriented row above and below. This is also shown in FIG. 11.

As the coal descends through the baffle tower 3 from the aperture 17 in the coal intake bin 2, it will descend by gravity through the baffle tower 3. The purpose of the baffles 21 is two-fold. First, the baffles provide the path for the process gases into and out of the processor. The inlet baffles are the means by which process gas is introduced into the processor, and process exhaust gas is collected and directed from (out of) the baffle tower by the outlet baffles. Second, the baffles provide a mechanical means by which the coal is mixed on its way to the spool discharge 6. This mixing or jostling ensures that the coal is evenly dried.

Figure 13:
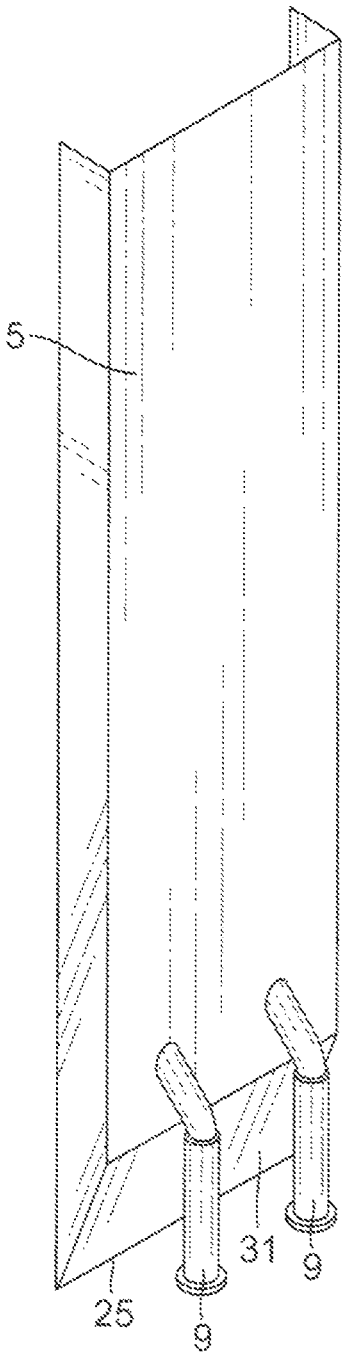
FIG. 13 is a perspective view of the exhaust plenum of the present invention.

FIG. 13 is a perspective view of the exhaust plenum of the present invention. The exhaust plenum 5 is affixed to and covers all of the baffle holes 16 in one of the side walls 15. The purpose of the exhaust plenum 5 is to collect exhaust gas exiting the baffle holes 16 in the side wall 15 and deliver that gas to a downstream process exhaust gas handling system (not shown) through the opening in the top of the plenum as shown or another opening in the plenum (not shown). Referring to FIG. 1, the exhaust tubing 9 allows water vapor released from the unprocessed, cooling coal that was not reabsorbed by the hot dried coal in the cooling auger to travel upward into the exhaust plenum 5. The pressure in the exhaust plenum 5 is less than the pressure in the cooling auger 8, which causes the released water vapor that is not absorbed to travel through the exhaust tubing 9 into the exhaust plenum 5. Although not shown in the figures, the top of the exhaust plenum 5 would be ducted to the downstream process exhaust gas handling system.

Figure 14:
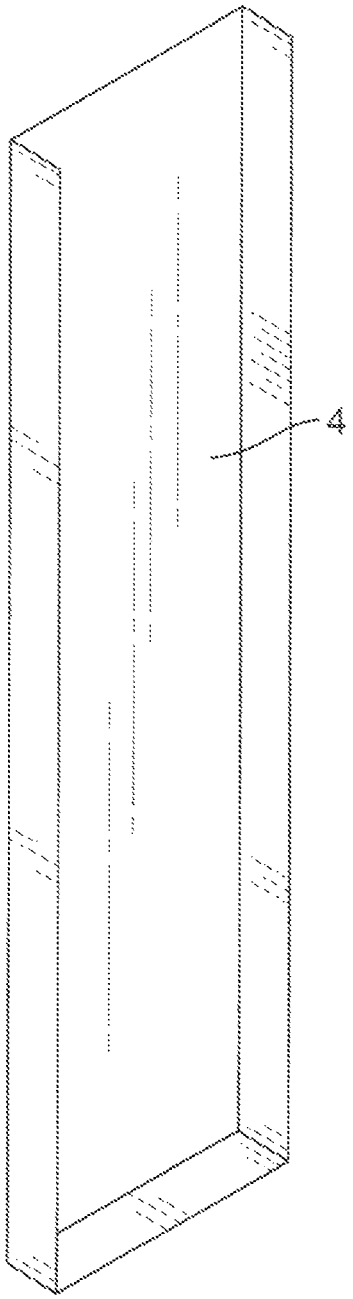
FIG. 14 is a perspective view of the inlet plenum of the present invention.

FIG. 14 is a perspective view of the inlet plenum of the present invention. The inlet plenum 4 is affixed to and covers all of the baffles holes 16 in the other side wall 15 (the one to which the exhaust plenum 5 is not affixed). The purpose of the inlet plenum is to ensure that the process gas (i.e., the gas used to dry the coal inside the baffle tower) is introduced evenly across the entire baffle tower 3. The process gas may be introduced into the inlet plenum 4 in any number of ways—for example, via the opening in the top of the plenum as shown or via separate tubing (not shown) into the side, bottom or outside wall of the inlet plenum 4. Once inside the inlet plenum 4, the process gas travels through the baffle holes 16 and enters the baffle tower 3 directly underneath each baffle 21 corresponding to a baffle hole 16. From there, the gas is generally dispersed within the baffle tower 3, but the baffles 21 ensure that the process gas is evenly distributed throughout the baffle tower 3. In this manner, the coal traveling downward through the baffle tower 3 will come into contact with the process gas during its entire pathway through the baffle tower 3. Although not shown, the top of the inlet plenum 4 would be ducted to the process gas delivery system (or source of the process gas).

Figure 15:
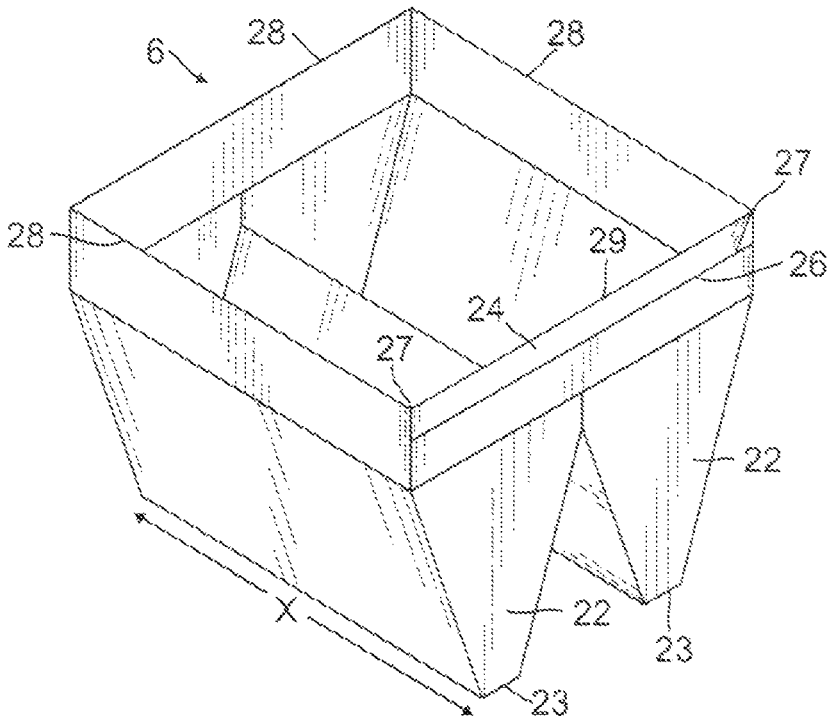
FIG. 15 is a side perspective view of the spool discharge of the present invention.
Figure 19:
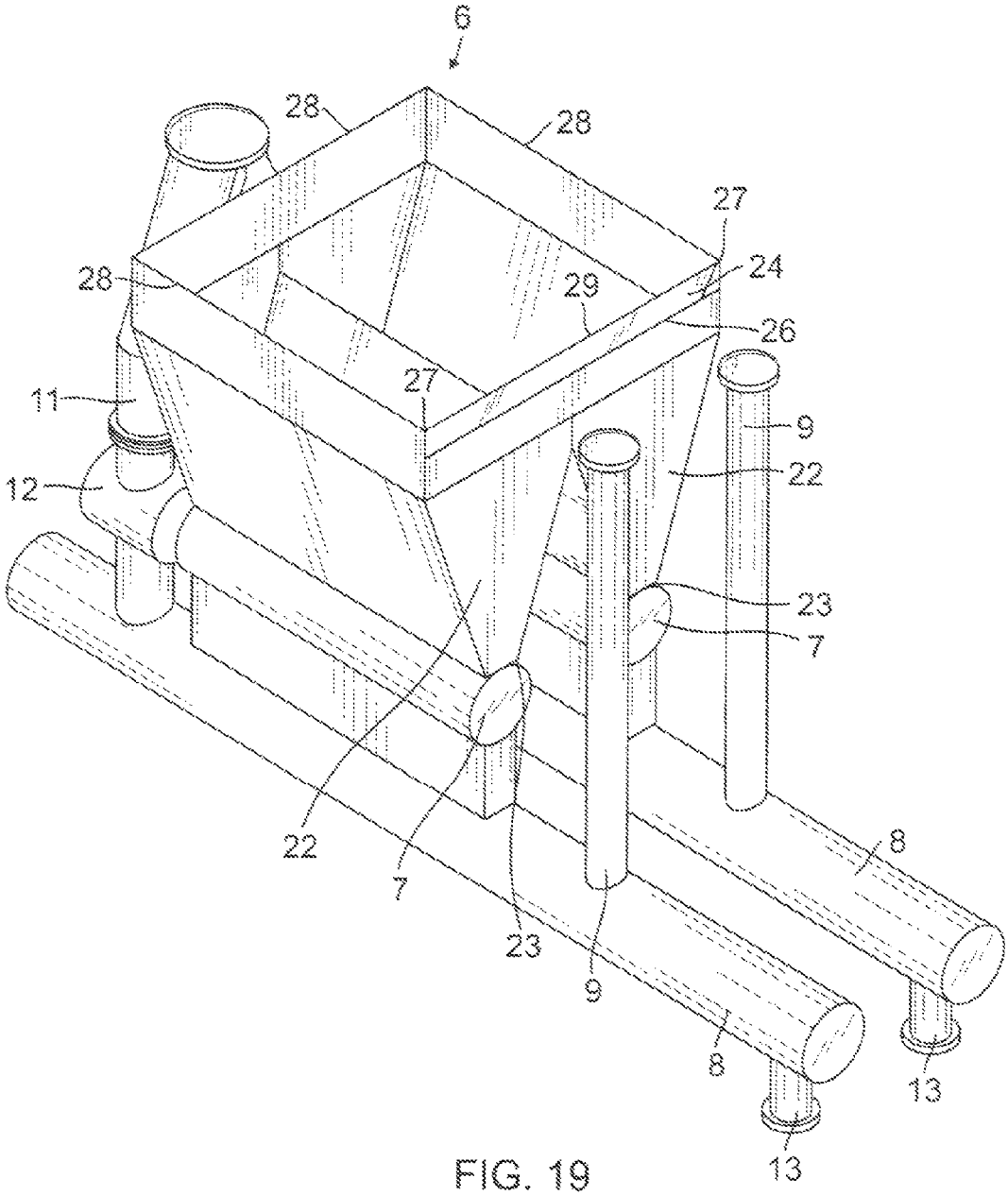
FIG. 19 is a first perspective view of the spool discharge, first flow regulators and cooling augers of the present invention.

FIG. 15 is a side perspective view of the spool discharge of the present invention. The purpose of the spool discharge 6 is to divide the coal that has traveled downward through the baffle tower 3 into two parts—one part that goes to one of the two first flow regulators 7, and another part that goes to the other of the two first flow regulators 7. As shown in FIG. 19, the width of the spool discharge 6 (shown as line "X" in FIG. 15) is roughly equal to the length of the first flow regulator 7. The spool discharge 6 preferably comprises, but is not limited to, two chambers 22, each of which comprises an open bottom end 23 that dumps coal into the first flow regulators 7.

Figure 16:
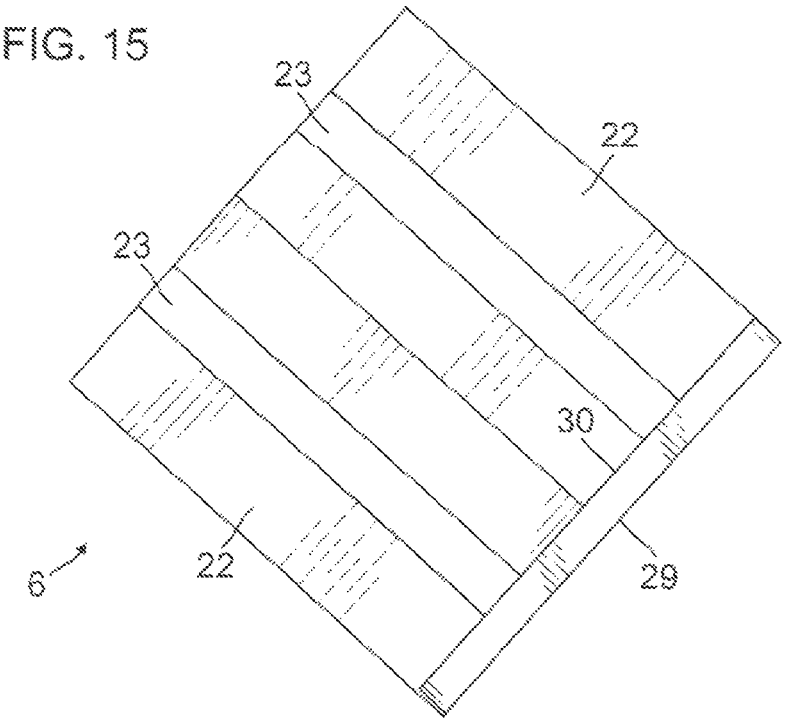
FIG. 16 is a top view of the spool discharge of the present invention.

The spool discharge 6 preferably comprises a slat 24, the top edge 29 of which joins the two top corners 27 of the spool discharge and is on the same horizontal plane as the other three top edges 28 of the outer walls of the spool discharge, and the bottom edge 30 of which lies downward and inward of the top edge 29 and inside the perimeter of the spool discharge (see FIG. 16). The bottom edge 25 of the sloped surface 31 of the exhaust plenum 5 is preferably coupled to the edge 26 of the spool discharge 6 that lies directly underneath the top edge 29 of the slat 24 (see also FIG. 18).

FIG. 16 is a top view of the spool discharge of the present invention. The purpose of the slat 24 is to allow particulates that may enter the exhaust plenum 5 to enter the spool discharge 6 rather than building up inside the exhaust plenum 5, which could result in a safety hazard. For this reason, the sloped surface 31 of the lower portion of the exhaust plenum 5 is preferably sharply slanted (in this example, seventy (70) degrees from horizontal), as shown in FIG. 13, to cause any particulates to fall by gravity into the spool discharge 6 via the slat 24. The spool discharge 6 is coupled to the bottom of the baffle tower 3.

Figure 17:
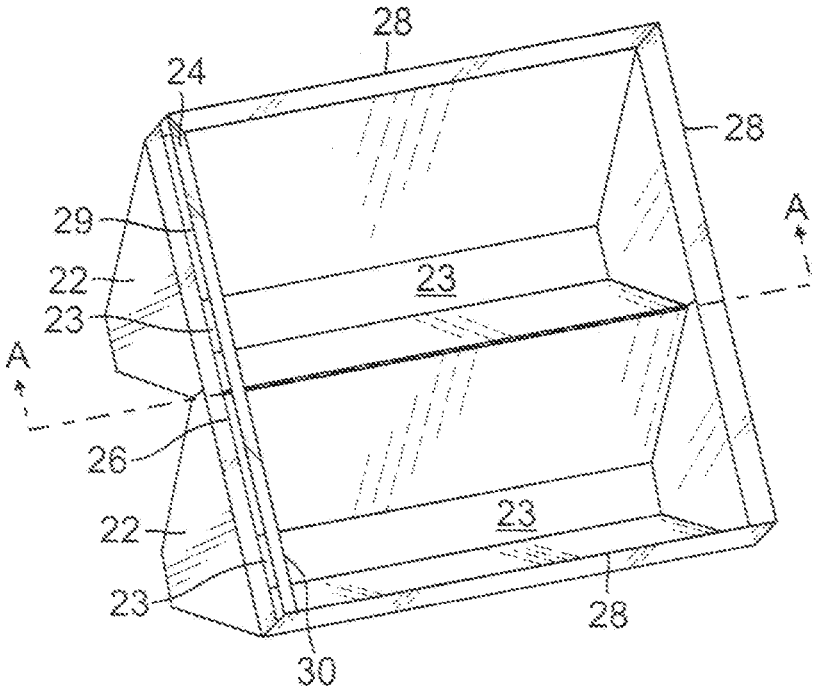
FIG. 17 is a top perspective view of the spool discharge of the present invention.
Figure 18:
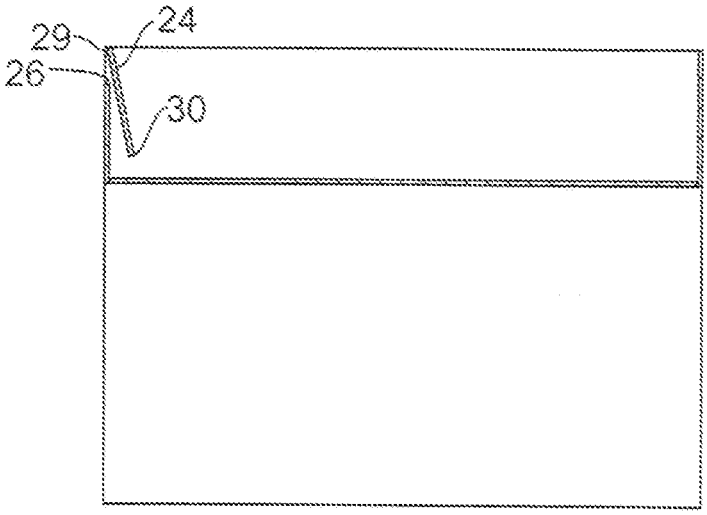
FIG. 18 is a section view of the spool discharge of the present invention.

FIG. 17 is a top perspective view of the spool discharge of the present invention. FIG. 18 is a section view of the spool discharge of the present invention. This figure is taken at section A-A of FIG. 17.

Figure 20:
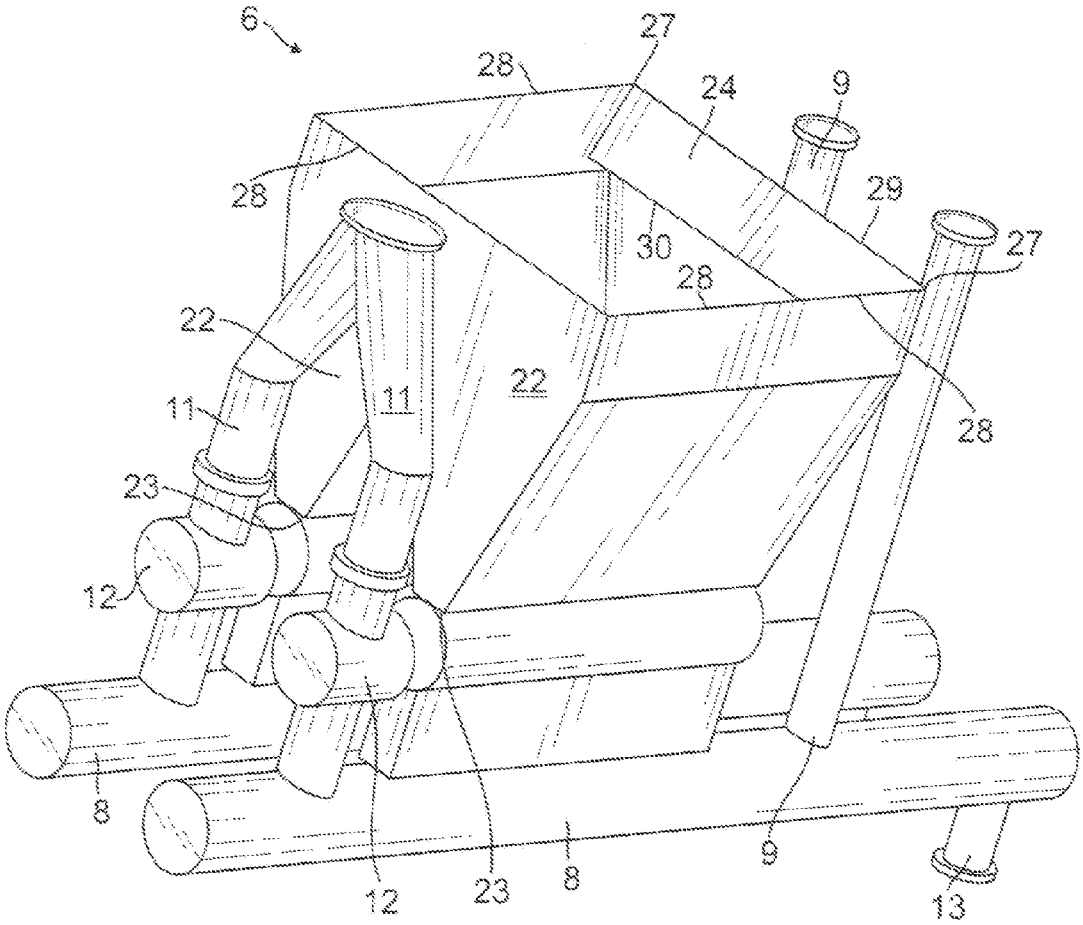
FIG. 20 is a second perspective view of the spool discharge, first flow regulators and cooling augers of the present invention.

FIG. 19 is a first perspective view and FIG. 20 is a second perspective view of the spool discharge, first flow regulators and cooling augers of the present invention. The purpose of each of these components is discussed above. As shown in this figure, the cooling coal from the coal intake tubing 10 enters the cooling augers 8 at the head end of the cooling augers 8 via the splitter 11 and second flow regulators 12. The hot, dried coal from the baffle tower 3 enters the cooling augers 8 along the middle of the cooling augers 8 via the spool discharge 6 and first flow regulators 7. Water vapor exits the cooling augers 8 and enters the exhaust tubing 9 toward the discharge end of the cooling augers 8. In this manner, cool, unprocessed coal from the coal intake tubing 10 and hot, dried coal from the baffle tower 3 are intermingled in the cooling augers 8 at the bottom of the processor 1.

Now that the structure of the present invention has been fully described, the operation and advantages of the present invention are discussed more fully below.

A significant advantage of the present invention is that it allows the coal to be dried without liberating VOCs. The rate of heating/drying is directly related to VOC liberation. If a particle is heated too quickly, the surface temperature will be much higher than the core temperature. Provided the moisture in the core of the particle is migrating toward the surface at a rate sufficient to maintain an acceptable surface temperature, then the organics will not thermally decompose, and VOCs will not be liberated. Stated another way, if the surface temperature is allowed to elevate due to the lack of the cooling provided by moisture migrating to the surface and evaporating, VOCs will be liberated and transported from the dryer in the exhaust gas.

The rate at which the coal is heated affects the rate at which the coal is dried and has a significant impact on the dried product. The present invention is designed to allow coal temperature to be increased at a rate no greater than 10° F. per minute and preferably less than 5° F. per minute. If the heating/drying rate is too fast, the coal will be reduced to smaller particles as a result of fracturing. If the heating/drying rate is too slow, the process becomes economically unacceptable. As each coal particle is heated, the rate of heat transfer into the particle is partially balanced by the moisture migration to and evaporation from the surface of the particle. When the rate of heat transfer exceeds the rate of moisture removal, some of the internal moisture converts to steam. This can fracture a particle and expose additional surfaces, further increasing the moisture release rate.

A particle of coal typically contains both organic material and mineral matter. The rate of heat transfer for the organic material is typically less than that of the mineral matter. During the process of drying, the organic material absorbs/transfers heat more slowly and contracts slightly with the loss of moisture. Concurrently, the mineral matter absorbs/transfers heat more rapidly and thermally expands. Mechanical forces exerted by differential expansion cause the mineral matter (ash) to be selectively liberated from the organic material as fracture typically occurs along the interfaces between the two components. In the desired situation, the coal would be heated quickly enough to liberate the mineral matter for cleaning purposes but slowly enough to avoid liberation of VOCs.

Furthermore, with the present invention, it is not necessary to reduce the size of the coal fed into the coal intake bin prior to drying. Because the top size of the feed is not reduced, the present invention processes more coal within a cleanable size range than other processes. With the present invention, about eighty percent (80%) of the product exiting the cooling augers should be cleanable. The cleanable percentage of final product may be as low as forty percent (40%) for fluid bed or vibrating bed products.

The present invention is uniquely constructed to allow each individual coal particle to be dried at a relatively slow rate, which allows the final product temperature of all such coal particles to be maintained sufficiently low to minimize the evolution of VOCs to negligible quantities. As discussed above and shown in the figures, the processor comprises a rectangular tube, oriented vertically and typically (though not necessarily) square in horizontal cross-section. Commencing at the bottom and continuing throughout the height of the processor are alternating layers or rows of baffles oriented horizontally. Each horizontal row is oriented perpendicular to the adjacent rows, located above and below each row.

Each row comprises several baffles lying parallel to one another, extending from one side to the opposite side of the baffle tower, and spaced across the baffle tower to accommodate coal flow downward through the baffle tower. As the coal flows downward, the baffles cause the coal to tumble back and forth in one direction (as the coal hits one row of baffles) and then back and forth in another direction (as the coal hits the next row down, that row being oriented perpendicularly to the row above it) past each successive pair of baffles. The minimum baffle spacing and base width are a function of the largest particle size to be admitted to the baffle tower. The included angle of the apex of the baffle is a function of the flow characteristics of the coal. In a preferred embodiment, the apex angle of each baffle is approximately fifty (50) degrees (see FIG. 21).

By way of further illustration, consider baffles arranged such that the odd-numbered layers (or rows) are oriented east-west, and the even-numbered layers are oriented north-south. Further, the east end of the baffles (in the odd-numbered rows), referred to as inlet baffles, are connected through the vertical east wall of the baffle tower to the inlet plenum attached to the east side of the baffle tower, and the north end of the baffles (in the even-numbered rows), referred to as outlet baffles, are connected through the vertical north wall of the baffle tower to the exhaust plenum attached to the north side of the baffle tower.

Process gas flows out of the inlet plenum attached to the east side of the baffle tower, into the triangular end of the inlet baffles, and travels along and under the canopy provided by the baffle to the opposite end of the baffle. As it does this, process gas will flow outward from and along this canopy (escaping from the base of the baffle) and into the coal that fills the space adjacent to the baffles. When the baffle tower 3 is filled with coal, which would ordinarily be the case during operation of the processor, the gas cannot leave an inlet baffle and get to an outlet baffle without traveling through the coal; thus, by virtue of the placement of the inlet and outlet baffles, the coal throughout the tower is continuously exposed to process gas.

As the process gas percolates through the coal, the heat energy in the process gas is transferred to the coal, heating and dehydrating the coal while cooling the process gas. The process exhaust gas, which is cooled process gas together with the moisture removed from the coal, will migrate to the nearest outlet baffle (it will not migrate to an inlet baffle due to differential pressure). The outlet baffle collects the process exhaust gas and delivers it to the exhaust plenum attached to the north side of the baffle tower.

The volumetric flow rate of the process gas into the coal is a function of the velocity allowed at the inlet, or triangular, opening of the end of a baffle that is open to the inlet plenum. In normal operation, the process gas is supplied at a low flow rate to heat the feed coal slowly. This extends the drying time and minimizes the potential for evolving VOCs from the coal. The present invention allows the temperature increase in the feed coal to be maintained at less than 10° F. per minute; in a preferred embodiment, the temperature increase is maintained between 1° F. and 5° F. per minute. The low flow rate minimizes the velocity of the process gas exiting the processor through the outlet baffles, minimizing the quantity of very fine particulate that may be elutriated from the coal. The larger particulates, if any, settle in the exhaust plenum 5 and are discharged into the spool discharge 6 via the slat 24.

In a preferred embodiment, the coal goes from ambient temperature at the intake end to a final desired temperature of approximately 200° F. after processing. At a temperature increase rate of 2.5° F. per minute, the coal would be in the processor for roughly an hour.

Each pair of baffle rows (i.e., one inlet row and one outlet row) acts as a discreet drier, and collectively these baffle row pairs provide a continuous drying operation throughout the height of the baffle tower. In the preferred embodiment described herein, the process gas would typically travel through seven (7) to fourteen (14) inches of coal before it enters the base of an outlet baffle. The inlet baffles in each pair of baffle rows receive process gas with the same composition and at the same temperature, and each pair of baffle rows generates coal that is progressively warmer and dryer than was received from the previous pair of baffle rows.

As shown in the figures, the baffle tower is preferably of a square cross-section with one inlet plenum and one exhaust plenum. Variations from this configuration include: two inlet plenums oriented opposite one another on the baffle tower, two exhaust plenums oriented opposite one another on the baffle tower, and/or a baffle tower with a rectangular horizontal cross-section. Selection of the appropriate configuration, which could include any one or more of these variations, would be dependent on available process gas temperature, moisture content of the feed coal, desired dried product moisture content, and allowable particulate loading in the process exhaust gas.

Prior to processing operations and before process gas is admitted to the baffle tower, the baffle tower would be filled with unprocessed coal. The first rotary locks 7 and spool discharge 6 fill initially as coal falls freely through the coal intake bin 2 and baffle tower 3. Once the first rotary locks 7 and spool discharge 6 are full of unprocessed coal, the baffle tower is filled, and then the coal intake bin is filled to the normal operating fill depth. The normal operating bin level, together with the high and low limits, would be established by the operator in advance and measured by a level indicator located in the coal intake bin. Process gas flow to the baffle tower may then be initiated.

Next, the first rotary locks 7 are activated to allow coal to be metered out of the baffle tower. Bin level indication in the coal intake bin 2 will then manage the flow of unprocessed coal into and the level of unprocessed coal in the coal intake bin. As steady state operations are approached, the first and second rotary locks 7, 12 will be managed by system requirements. Operational control of the first rotary lock 7 will be a function of the unprocessed coal and dried product moisture contents. Control of the second rotary lock 12 will be a function of the final dried coal temperature required.

The bed of coal, which travels into, through and from the baffle tower, flows in the same fashion as coal would flow into, through and from a bin. The height of the bed of coal to be processed would typically be thirty (30) to fifty (50) feet with the baffle tower containing more than one hundred (100) tons of coal. The bed of coal in the baffle tower could be considered to be quiescent and would typically have a bed density approximating the bulk density of the coal in live storage.

No part of the bed is fluidized, either mechanically or pneumatically. Only the very fine particles (0.006 inch (100 mesh) and smaller, typically) are elutriated from the coal and exit with the process exhaust gas. The differential pressure required to force the process gas from an inlet baffle, through the coal, and into an outlet baffle is nominally less than fifteen (15) inches of water column (IWC). By contrast, fluid beds could require as much as 120 IWC, and vibrating fluid beds typically require approximately 45 IWC. The compressive energy requirement is a function of the differential pressures required. Compressive energy is a major component in the operating cost of a process. In this case, the compressive energy requirements of the present invention, are substantially lower than those of fluid bed and vibrating fluid bed technologies.

In an alternate embodiment of the present invention, the coal is still heated and dried, but the heated and dried (warm) coal is not then mixed with the as received, or unprocessed (cool), coal. For these applications, the invention is modified to eliminate the coal intake tubing 10, the splitter 11, and the second flow regulators 12. With this alternate embodiment, the components identified as the "cooling augers 8" do not mix cool and warm coal as they transport the mixed coal out of the invention; instead, they simply transport the warm coal out of the invention. In this alternate embodiment, the parts previously described as "cooling augers" are more properly described as "conveyance devices."

In another alternate embodiment, the structure of the invention is modular. Whereas the initial embodiment (now patented under U.S. Pat. No. 8,371,041) comprises a single baffle tower, a single inlet plenum, and a single exhaust plenum, this alternate embodiment comprises multiple segmented units, wherein each segment comprises a processor segment, an inlet plenum, and an exhaust plenum, and wherein multiple segments are stacked vertically.

As explained more fully below, the segmented inlet plenums and exhaust plenums may be constructed with different cross-sectional flow areas so that the flow velocity is more or less equivalent through all of the inlet plenums and more or less equivalent through all of the exhaust plenums. The gas flow rates into each processor segment are approximately equal. The inlet plenums may be connected in series with a single common inlet. The exhaust plenums may be connected in series with a single common exhaust; alternately, the exhaust from one or more segments may be isolated from the rest and sent to separate outlet pipes for treatment disposal or recycling.

In one embodiment of the modular design, the invention is constructed so that process gas enters through the top inlet plenum and exhaust gas exits through the top exhaust plenum. In an alternate embodiment, the invention is constructed so that process gas enters through the bottom inlet plenum and exhaust gas exits through the bottom exhaust plenum. In yet another alternate embodiment, process gas enters through the top inlet plenum and exhaust gas exits through the bottom exhaust plenum. In yet another alternate embodiment, process gas enters through the bottom inlet plenum and exhaust gas exits through the top exhaust plenum. In yet another alternate embodiment, process gas enters through the top inlet plenum and exhaust gas exits through multiple exhaust plenums. In yet another alternate embodiment, process gas enters through the bottom inlet plenum and exhaust gas exits through multiple exhaust plenums.

Some components of the modular embodiments remain unchanged from the initial embodiment. The unchanged components include those components located above and below the baffle tower (namely, the coal intake bin 2, spool discharge 6, first flow regulator 7, cooling augers 8, exhaust tubing 9, coal intake tubing 10, splitter 11, second flow regulator 12, and coal discharge tubing 13). The drawings of the modular embodiments (FIGS. 22-30), as well as the following descriptions, reference three stacked modular segments; however, the present invention is not limited to any particular number of modular segments, nor to the number of baffle pairs or the number of baffles in each row contained in each segment.

Figure 22:
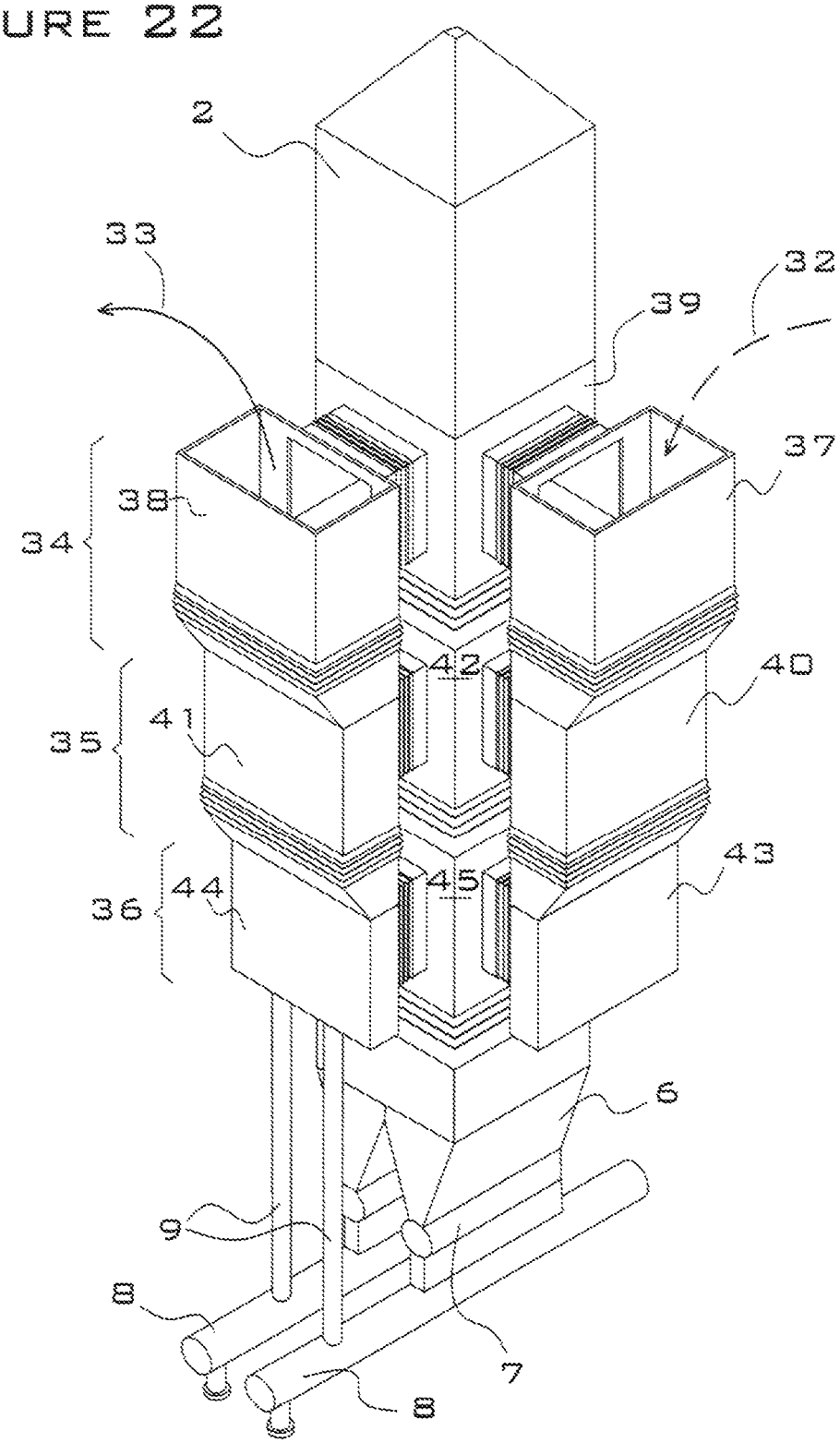
FIG. 22 is a perspective view of a modular embodiment of the present invention in which process gas enters through the top inlet plenum and exhaust gas exits through the top exhaust plenum, shown with the process and exhaust gas piping removed for clarity.

FIGS. 22-26 illustrate the modular embodiment in which process gas enters through the top inlet plenum and exhaust gas exits through the top exhaust plenum. FIG. 22 is a perspective view of this embodiment shown with the process and exhaust gas piping removed for clarity. A dashed arrow 32 represents the path of process gas flowing into the invention, and a solid arrow 33 represents the path of exhaust gas flowing out of the invention. This figure shows the coal intake bin 2 and three modular segments—first modular segment 34, second modular segment 35, and third modular segment 36—spool discharge 6, first flow regulator 7, two cooling augers 8, and two pieces of exhaust tubing 9. Note that the processor may be comprised of more than three segments, which could be inserted between either the first and second modular segments or between the second and third modular segments. Note also that cooling augers 8 may also be described as and/or replaced with conveyance devices, as explained above. The first modular segment 34 comprises a first inlet plenum 37, a first exhaust plenum 38, and a first processor segment 39. The second modular segment 35 comprises a second inlet plenum 40, a second exhaust plenum 41, and a second processor segment 42. The third modular segment 36 comprises a third inlet plenum 43, a third exhaust plenum 44, and a third processor segment 45.

Figure 23:
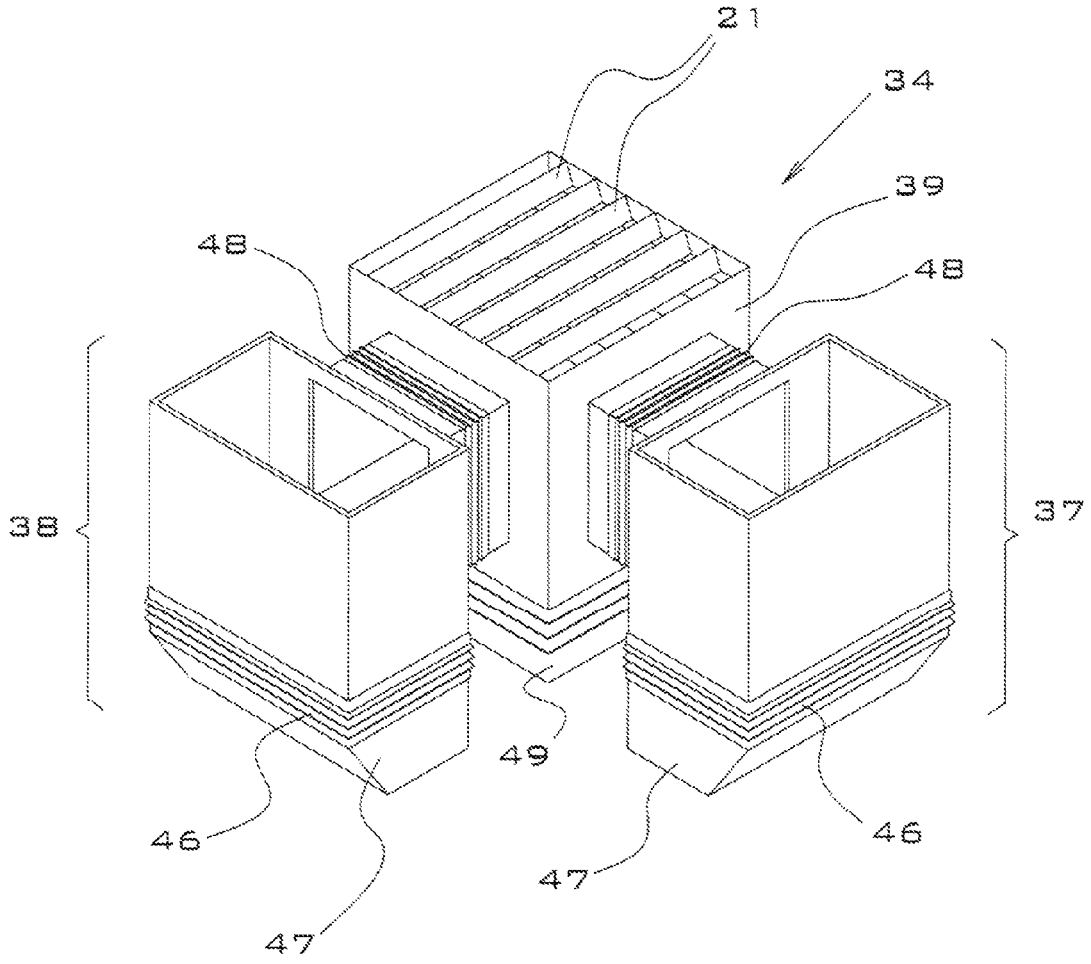
FIG. 23 is a perspective view of the first modular segment of the embodiment shown in FIG. 22.

FIG. 23 is a perspective view of the first modular segment 34 of the embodiment shown in FIG. 22. As shown, the first inlet plenum 37 comprises a plenum segment expansion joint 46 (inlet), a first plenum segment spool connector 47 (inlet), and a plenum-to-processor segment expansion joint 48. The first exhaust plenum 38 comprises a plenum segment expansion joint 46 (outlet), a first plenum segment spool connector 47 (outlet), and a plenum-to-processor segment expansion joint 48. The first processor segment 39 comprises a processor segment expansion joint 49 and baffles 21. It should be understood that the total inlet gas volumetric flow rate will not necessarily equal the combined exhaust volumetric flow rate because the process gas is cooled as it moves through the system. The goal is to maintain a relatively constant gas velocity through the plenum segments.

The baffles 21 are identical to the baffles described in reference to the initial embodiment; that is, the baffles 21 are comprised of alternating stacked rows of inverted-v-shaped inlet and outlet baffles, with the direction of the inlet baffles perpendicular to the direction of the outlet baffles, as described above. Although the examples shown in FIGS. 23-29 illustrate six baffles in each row, the present invention is not limited to any particular number of baffles per row.

The purpose of the plenum segment expansion joints 46, the plenum-to-processor segment expansion joints 48, and the processor segment expansion joints 49 is to provide flexibility to the invention to allow for expansion and contraction of the various components of the invention during heating and cooling cycles. The plenum segment expansion joints 46 and plenum-to-processor segment expansion joints 48 form a gas-tight seal. One possible configuration of the processor segment expansion joint 49 is described in detail in reference to FIG. 30; however, the present invention is not limited to this particular configuration.

Figure 24:
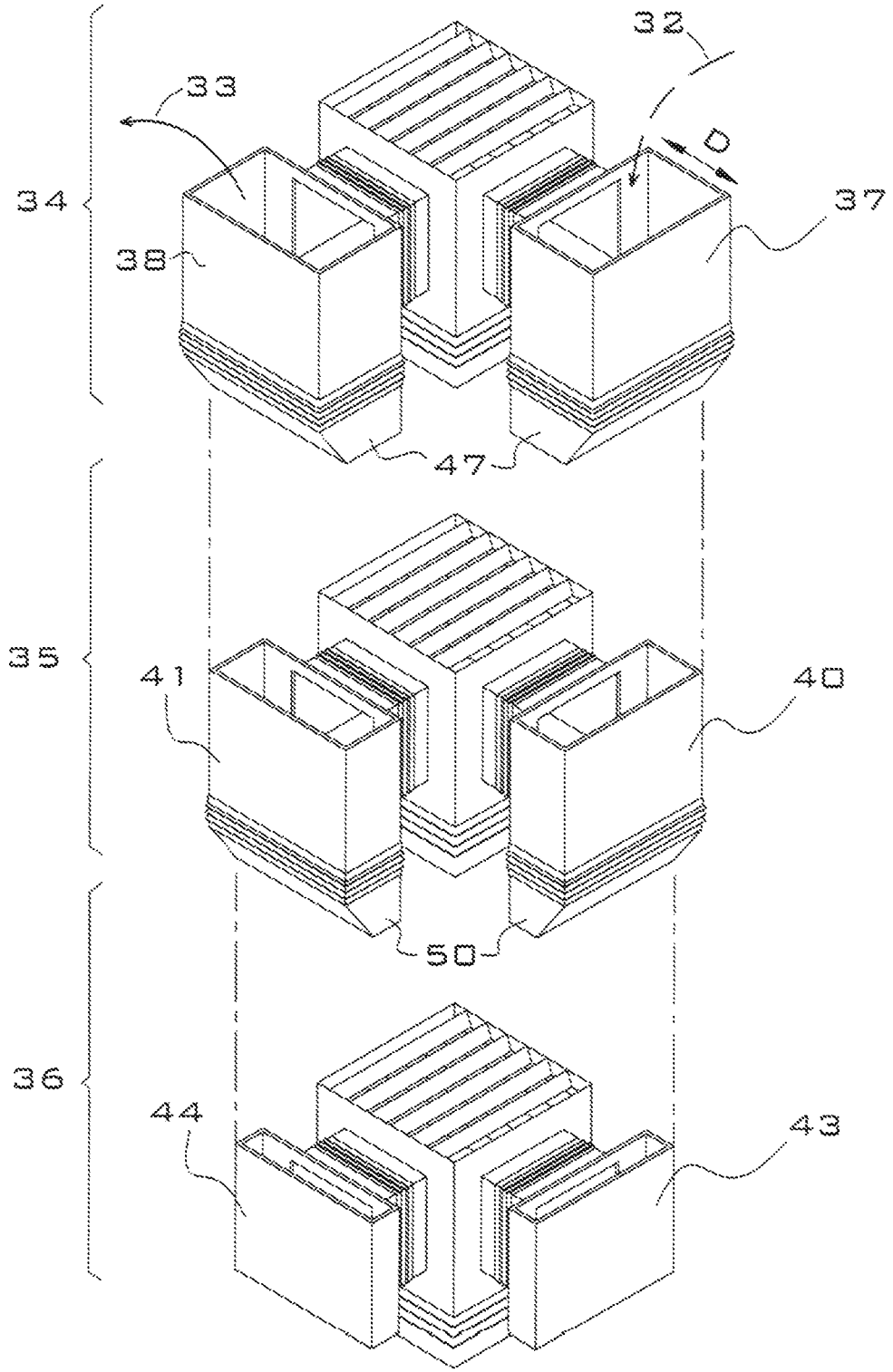
FIG. 24 is an exploded partial perspective view of the embodiment shown in FIG. 22.

FIG. 24 is an exploded partial perspective view of the embodiment shown in FIG. 22. Note that gas flow arrows are shown on FIG. 24. This figure shows the first modular segment 34, the second modular segment 35, and the third modular segment 36. Each inlet plenum 37, 40, 43 has a single inlet through which process gas is received. The first inlet plenum in the series receives its incoming process gas from a process gas source. Each subsequent inlet plenum in the series receives its incoming process gas from the prior inlet plenum in the series. Each inlet plenum delivers gas to its corresponding processor segment and also to the next inlet plenum in the series (except for the last inlet plenum, which does not deliver any gas to a subsequent inlet plenum). Each exhaust plenum 38, 41, 44 receives exhaust gas from its corresponding processor segment and also from the previous exhaust plenum in the series (except for the first exhaust plenum, which does not receive exhaust gas from any previous exhaust plenum). Each exhaust plenum has a single outlet. All exhaust plenums deliver exhaust gas to the next exhaust plenum in the series (except for the last exhaust plenum, which delivers it to suitable handling equipment).

As shown, the depth of the second inlet plenum 40 is smaller than the depth (identified by dimension arrows labeled "D") of the first inlet plenum 37, and the third inlet plenum 43 is smaller in depth than the second inlet plenum 40. Similarly, the second exhaust plenum 41 is smaller in depth than the first exhaust plenum 38, and the third exhaust plenum 44 is smaller in depth than the second exhaust plenum 41. Note that the depth of the first inlet plenum 37 is not necessarily equal to the depth of the first exhaust plenum 38; typically, the former would be larger than the latter because the process gas entering the inlet plenum is hotter than the process gas (cooled by transferring heat energy to the coal) leaving the exhaust plenum. As shown, the first plenum segment spool connectors 47 serve as transition fittings between the individual plenum segment expansion joints and the adjacent plenums, enabling the tops of the second inlet plenum 40 and the second exhaust plenum 41 to conform to the bottoms of the plenum segment expansion joints 46. Similarly, the second plenum segment spool connectors 50 of the second modular segment 35 enable the third inlet plenum 43 to conform to the plenum segment expansion joints (not labeled) of the second inlet plenum 40, and they also allow the third exhaust plenum 44 to form a flush fit with the second exhaust plenum 41.

Figure 25:
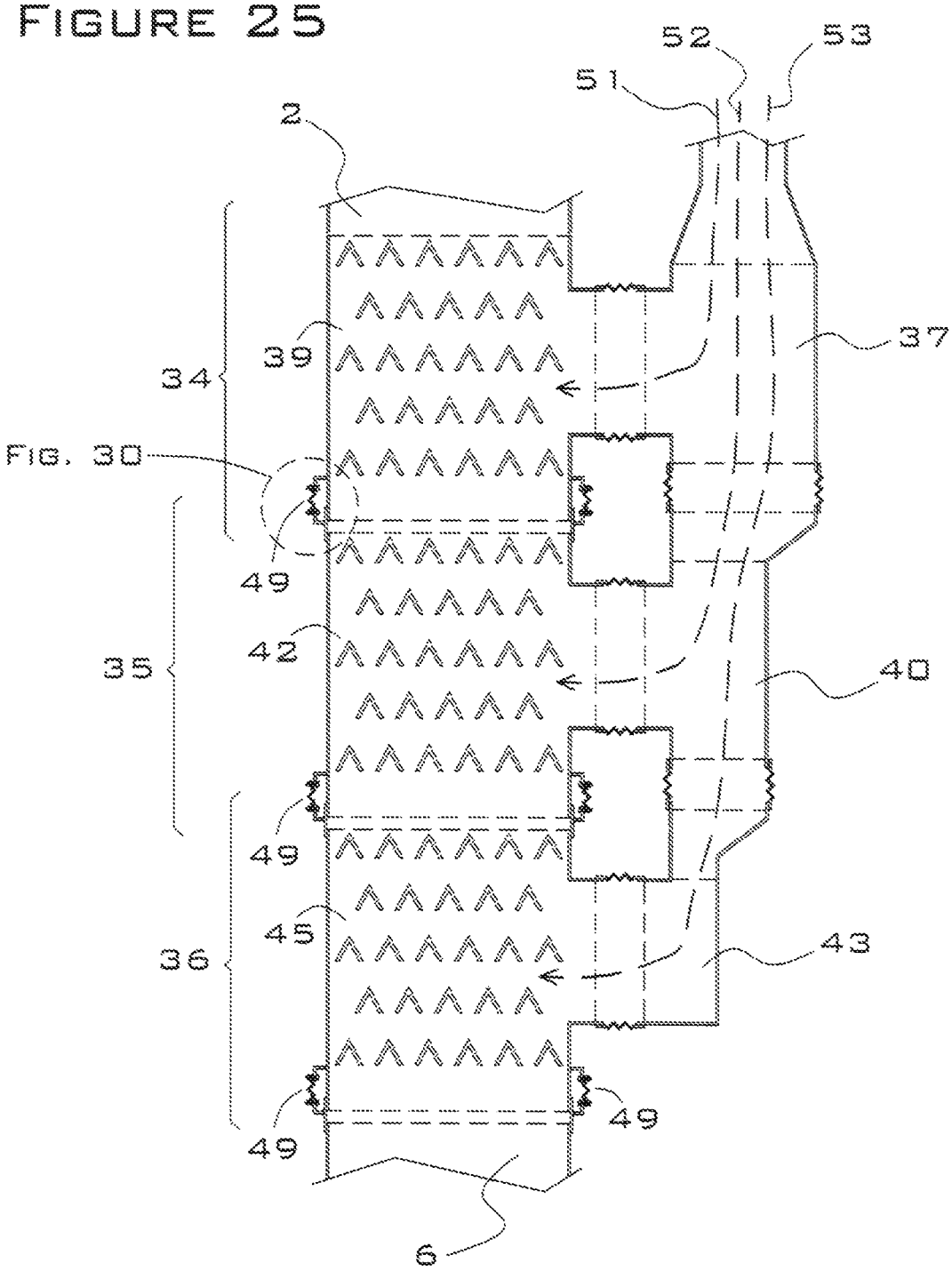
FIG. 25 is a first partial side cross-section view of the embodiment shown in FIG. 22.

FIG. 25 is a first partial side cross-section view of the embodiment shown in FIG. 22. This figure shows the first modular segment 34, the second modular segment 35, and the third modular segment 36, fully assembled, with the first inlet plenum 37, the second inlet plenum 40, and the third inlet plenum 43 visible. FIG. 25 illustrates the process gas flow paths occurring within this embodiment. The process gas is comprised of a first portion 51 that enters the first processor segment 39 via the first inlet plenum 37; a second portion 52 that enters the second processor segment 42 via the second inlet plenum 40; and a third portion 53 that enters the third processor segment 45 via the third inlet plenum 43.

All three portions 51, 52, 53 of the process gas flows have similar volumetric flow rates (e.g., cubic feet per minute). In other words, the volumetric flow rate of the process gas flowing into each of the processor segments 39, 42, 45 is roughly the same. This assumes that the number of baffle pairs is the same for each modular segment and that the number of baffles per row is the same for each modular/processor segment. All three portions 51, 52, and 53 of the process gas enter the first inlet plenum 37, but only the second portion 52 and the third portion 53 of the process gas enter the second inlet plenum 40, and only the third portion 53 of the process gas enters the third inlet plenum 43, as illustrated by the arrows 51, 52, and 53; therefore, approximately one-third of the total process gas flows into the third inlet plenum 43, about two-thirds of the total process gas flows into the second inlet plenum 40, and all of the process gas flows into the first inlet plenum 37.

For an embodiment with any number "n" plenums in series, the last plenum (the number "n" plenum) is constructed so as to have a cross-sectional area equal to 1/n the cross-sectional area of the first plenum, while the next-to-last plenum (the "n−1" plenum) has a cross-sectional area equal to 2/n of the first plenum, the second-to-last plenum (the "n−2" plenum) has a cross-sectional area equal to 3/n, etc. For example, for an embodiment with five inlet plenums in series, the cross-sectional areas of the five inlet plenums (from last to first) would be 1/5, 2/5, 3/5, 4/5 and 5/5 of the cross-sectional area of the first inlet plenum, respectively.

The process gas flow rate into each successive inlet plenum is reduced by the flow rate of the gas that is delivered to each successive processor segment. Similarly, the exhaust gas flow rate into a given exhaust plenum from the previous exhaust plenum in the series is increased by the flow rate of the gas that is delivered from each corresponding processor segment. By making the cross-sectional flow area of each successive plenum proportional to the flow rate of the gas flowing into the plenum (in the case of an exhaust plenum, this includes both the incoming gas from the corresponding processor segment and the incoming gas from the previous exhaust plenum), gas velocity through each plenum is approximately equivalent to that of the other plenums. This is desirable for performance of the invention, particularly the exhaust plenums where particulates will be entrained in the exhaust gas, and gas velocities must be maintained sufficiently high to prevent particulates from accumulating in the exhaust gas handling system. The cross-sectional areas of the three inlet plenums 37, 40, and 43 are varied with respect to each other by adjusting the depths ("D") of the three plenums, as shown in FIG. 24. FIG. 25 also shows the processor segment expansion joints 49. Expansion joints form flexible connections between the three components of the processor segments and the attached components.

Figure 26:
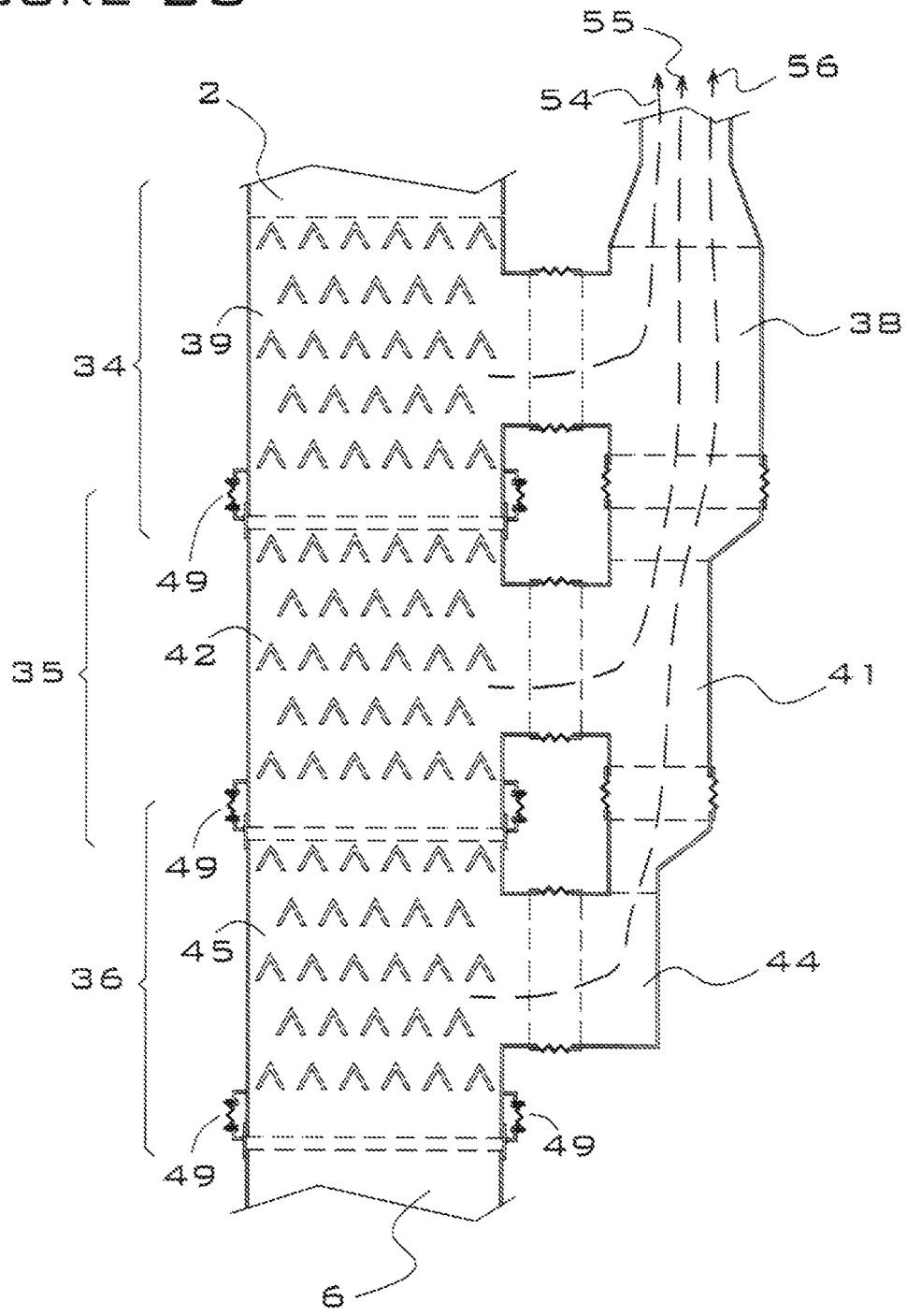
FIG. 26 is a second partial side cross-section view of the embodiment shown in FIG. 22.

FIG. 26 is a second partial side cross-section view of the embodiment shown in FIG. 22. This figure shows the first modular segment 34, the second modular segment 35, and the third modular segment 36, fully assembled, with the first exhaust plenum 38, the second exhaust plenum 41, and the third exhaust plenum 44 visible. FIG. 26 illustrates the exhaust gas flow paths occurring within this embodiment. As shown, the depths of the exhaust plenums 38, 41, and 44 are sized in an identical manner to the inlet plenums, as described in reference to FIG. 25.

Figure 27:
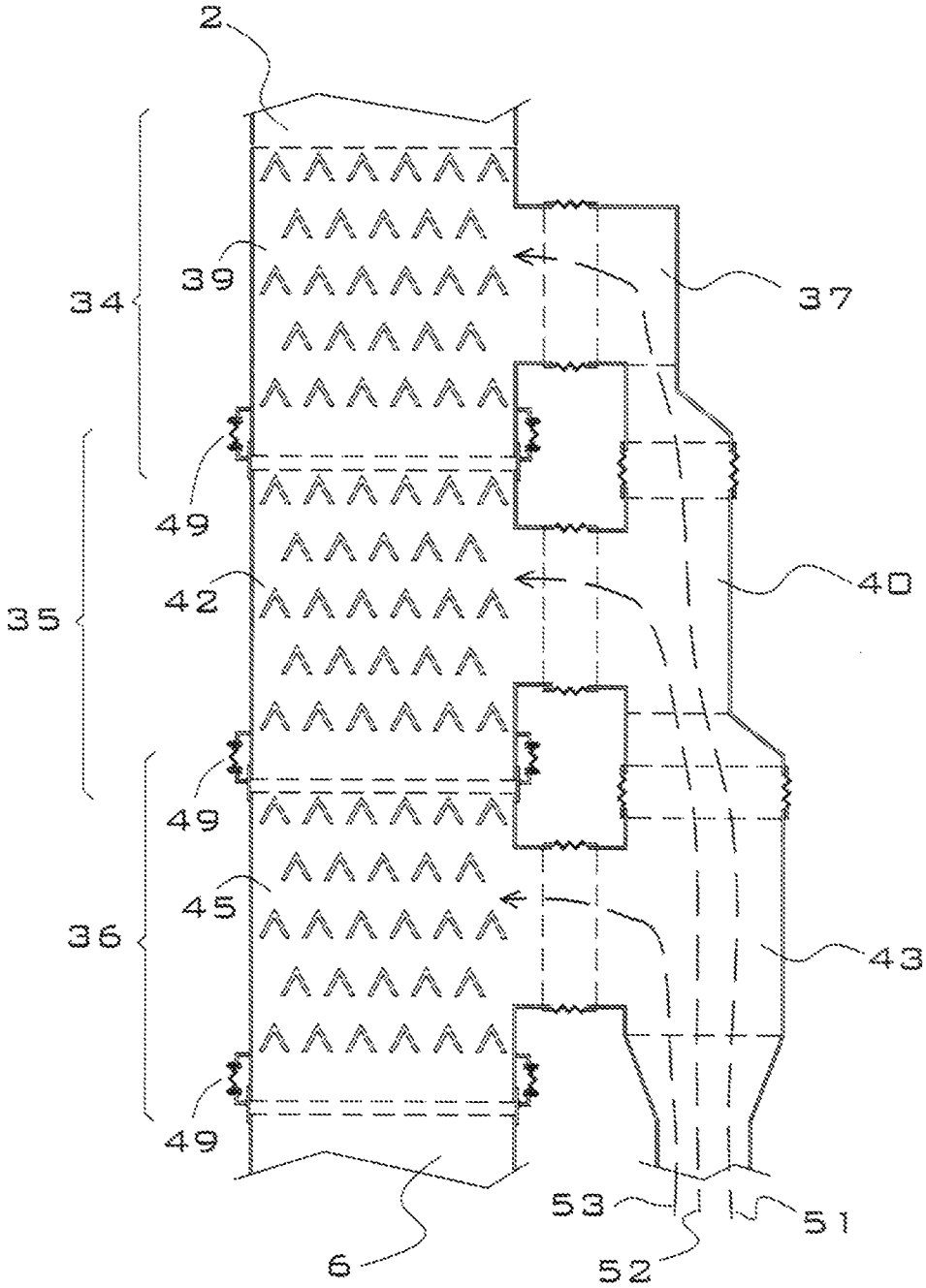
FIG. 27 is a first partial side cross-section view of an alternate embodiment of the present invention in which process gas enters through the bottom inlet plenum and exhaust gas exits through the bottom exhaust plenum.
Figure 28:
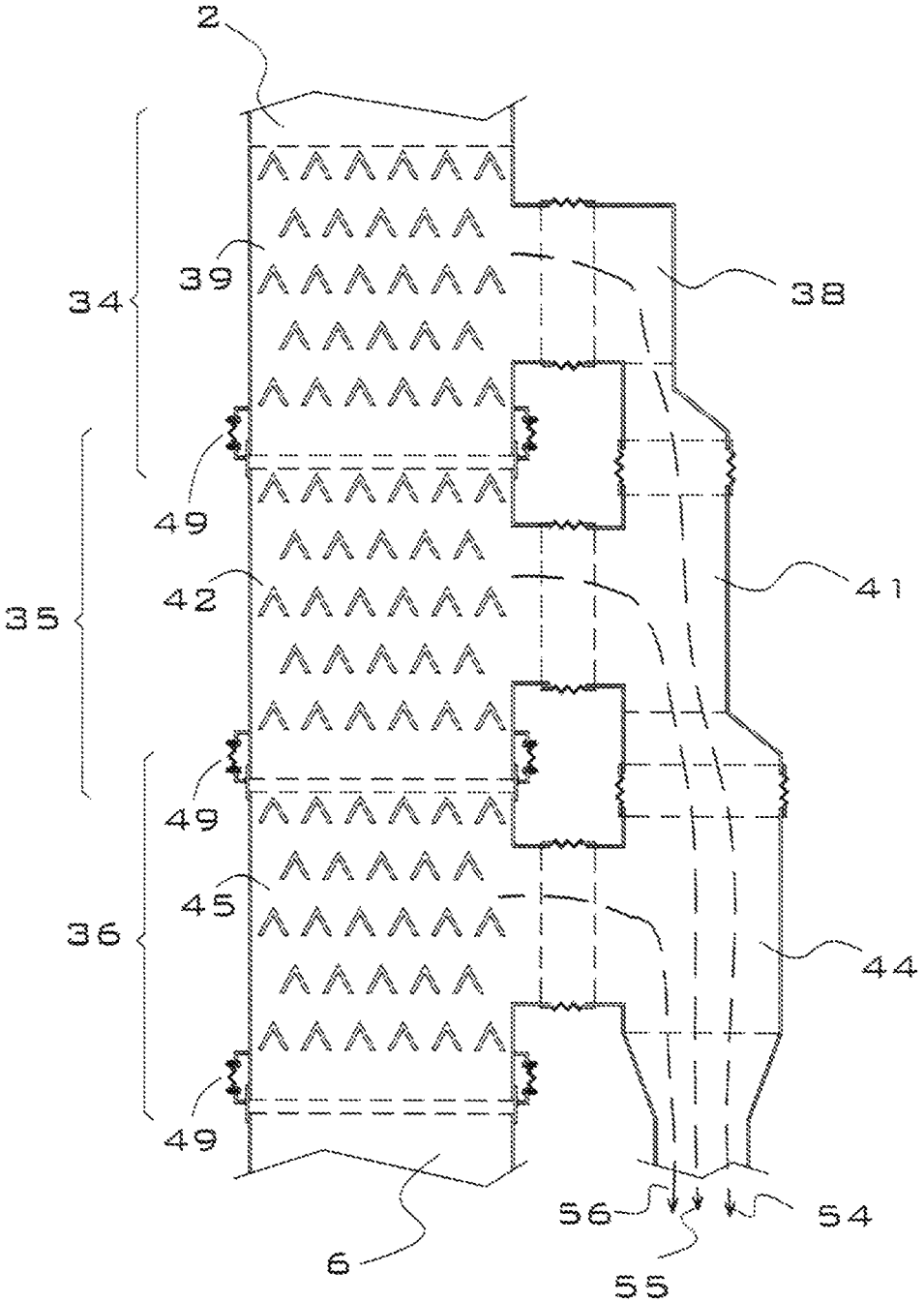
FIG. 28 is a second partial side cross-section view of the embodiment shown in FIG. 27.

FIGS. 27 and 28 illustrate the modular embodiment in which process gas enters through the bottom inlet plenum and exhaust gas exits through the bottom exhaust plenum. FIG. 27 illustrates the flow path of the process gas, and FIG. 28 illustrates the flow path of the exhaust gas. FIG. 27 shows the first modular segment 34, the second modular segment 35, and the third modular segment 36, fully assembled, with the first inlet plenum 37, the second inlet plenum 40, and the third inlet plenum 43 visible. With this embodiment, the process gas enters the invention through the bottom plenum, which is the third plenum 43 (the inlet plenums are referred to in sequence from top to bottom, relative to coal flow, regardless of whether the process gas enters through the top or bottom plenum). As shown, all of the inlet gas enters the third inlet plenum 43, and a first portion 51 of the process gas is directed into the first processor 39; a second portion 52 of the process gas is directed into the second processor 42, and a third portion 53 of the process gas is directed into the third processor segment 45. As shown, the depths (and, therefore, the cross-sectional flow areas) of the three inlet plenums 37, 40, and 43 are sized proportionally to their gas flow rates, as described above in relation to the previous embodiment.

FIG. 28 shows the first modular segment 34, the second modular segment 35, and the third modular segment 36, fully assembled, with the first exhaust plenum 38, the second exhaust plenum 41, and the third exhaust plenum 44 visible. With this embodiment, the exhaust gas exits the invention from the bottom plenum, which is the third plenum 44 (the exhaust plenums are referred to in sequence from top to bottom regardless of whether the exhaust gas exits through the top or bottom plenum). The three exhaust plenums 38, 41, and 44 are sized in an identical manner to the inlet plenums, as described in reference to FIG. 27.

In an alternate modular embodiment (not shown), process gas enters through the top inlet plenum and exhaust gas exits through the bottom exhaust plenum. This embodiment is constructed so that process gas enters the top inlet plenum identically to that of the embodiment shown in FIG. 25, and exhaust gas exits the bottom exhaust plenum identically to that of the embodiment shown in FIG. 28.

In another alternate modular embodiment (not shown), process gas enters through the bottom inlet plenum and exhaust gas exits through the top exhaust plenum. This embodiment is constructed so that process gas enters the bottom inlet plenum identically to that of the embodiment shown in FIG. 27, and exhaust gas exits the top exhaust plenum identically to that of the embodiment shown in FIG. 26.

Figure 29:
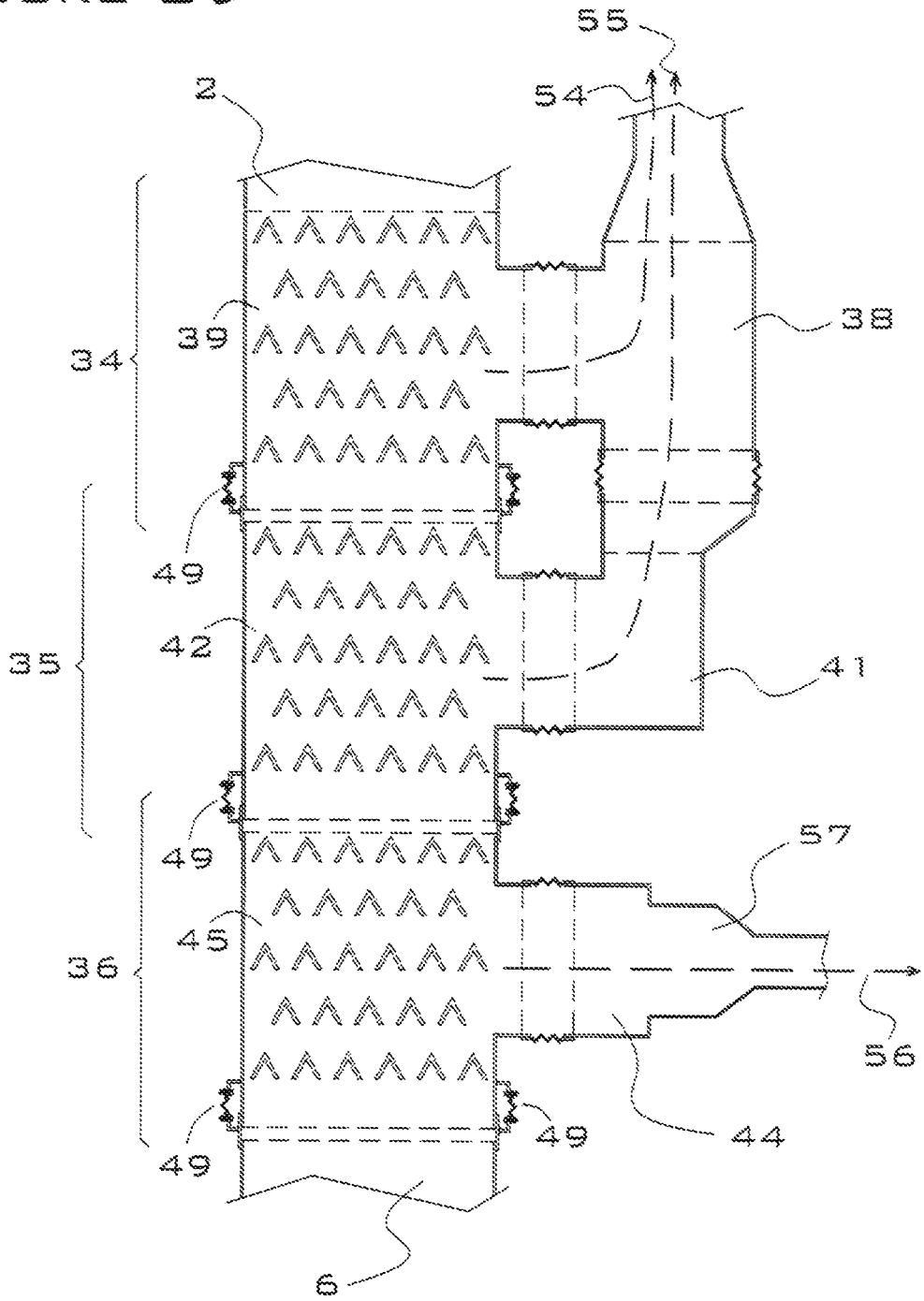
FIG. 29 is a partial side cross-section view of an alternate embodiment of the present invention in which process gas enters through the top inlet plenum and exhaust gas exits through multiple exhaust plenums.

FIG. 29 illustrates the modular embodiment in which process gas enters through the top inlet plenum and exhaust gas exits through multiple exhaust plenums. This figure shows the first modular segment 34, the second modular segment 35, and the third modular segment 36, fully assembled, with the first exhaust plenum 38, the second exhaust plenum 41, and the third exhaust plenum 44 visible. In this embodiment, the first portion 54 and the second portion 55 of the exhaust gas exit the invention via the first exhaust plenum 38. The third portion 56 of the exhaust gas exits the invention via a high-temperature processor exhaust port 57 and is handled/processed separately from the first portion 54 and second portion 55 of the exhaust gas. This embodiment may be preferred when certain gases, such as VOCs, are present in the third portion 56 of exhaust gas but not present in the other portions 54, 55 of the exhaust gas. In this embodiment, process gas enters the top inlet plenum. The inlet plenums for this embodiment are the same as shown previously in FIG. 25.

In an alternate modular embodiment (not shown), process gas enters through the bottom inlet plenum and exhaust gas exits through multiple exhaust plenums. This embodiment is similar to the embodiment shown in FIG. 29, except that process gas enters through the bottom inlet plenum, as shown in FIG. 27. In this embodiment, exhaust gas exits from multiple exhaust plenums, as shown in FIG. 29.

Figure 30:
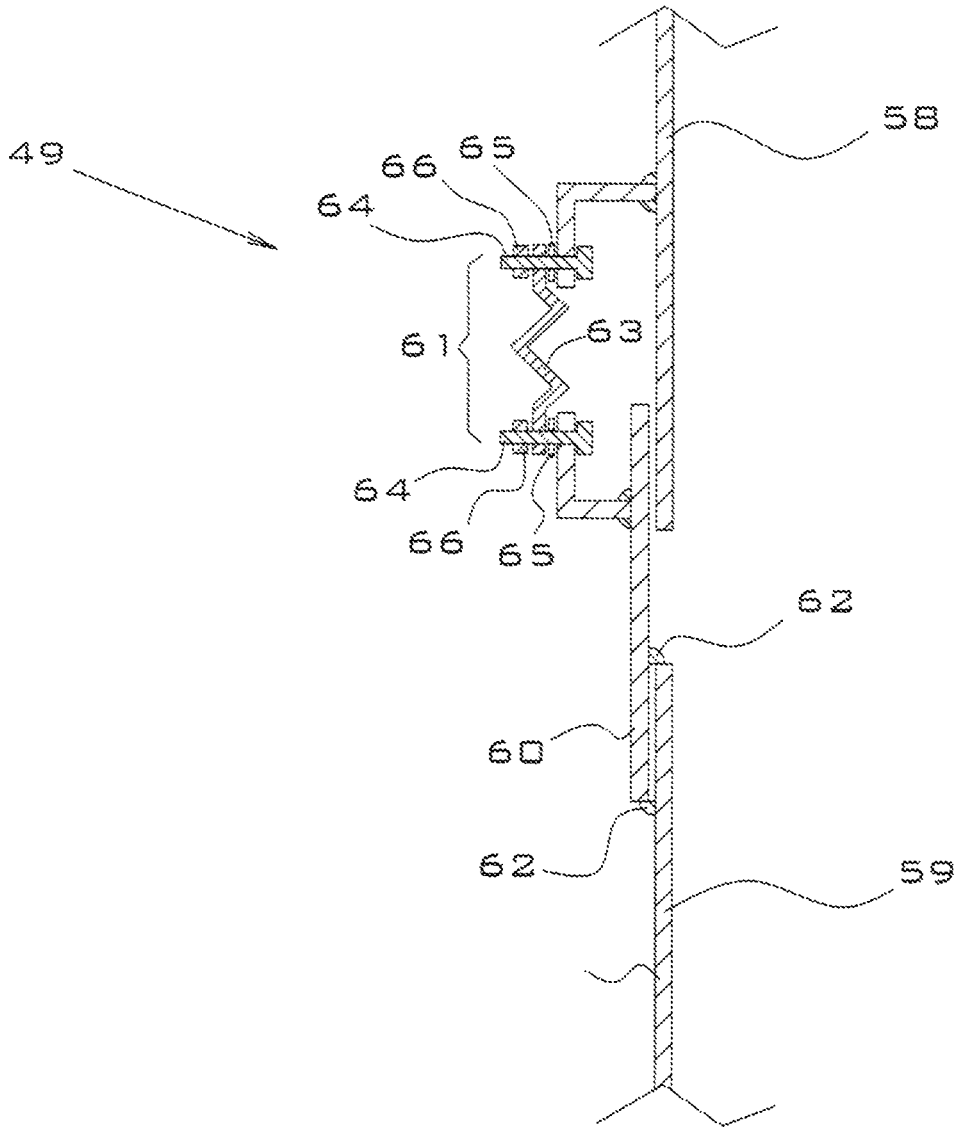
FIG. 30 is a cross-section side view of one edge of the processor segment expansion joint.

FIG. 30 is a cross-section side view of one edge of a processor segment expansion joint 49. The purpose of this component is to: (1) provide a low-friction sliding surface for coal to drop from one processor segment to an adjoining processor segment below while preventing the escape of coal particles; (2) provide a gas-tight seal to prevent gases from escaping from the invention between two adjacent processor segments; and (3) provide a flexible connection that allows for expansion and contraction of two adjoining processor segment during operation of the invention.

As shown in FIG. 30, the processor segment expansion joint 49 connects the outer walls of an upper processor segment 58 and a lower processor segment 59. The processor segment expansion joint 49 comprises a particulate retainer 60 and a flexible gas-tight seal 61. The particulate retainer 60 is welded to the wall of the lower processor segment 59 (with weld points 62) and slides up and down along the outside edge of the wall of the upper processor segment 58 when the vertical separation between the upper processor segment 58 and the lower processor segment 59 changes due to expansion or contraction of the invention due to heating or cooling. The purpose of the particulate retainer 60 is to provide a low-friction surface for coal to slide against as it drops from the upper processor segment 58 into the lower processor segment 59 and to prevent particles of coal from escaping from the system.

The gas-tight seal 61 comprises an accordion-folded metal strip 63, bolts 64, gaskets 65, and nuts 66. The purpose of the gas-tight seal 61 is to contain any gas that escapes between the wall of the upper processor segment 58 and the sliding plate 60, thereby preventing process and exhaust gasses from escaping the system through the processor segment expansion joints.

All of the modular embodiments described above are similar to the initial embodiment of the invention in that they comprise components for mixing cool coal with the processed coal. These mixing components comprise the coal intake tubing 10, the splitter 11, and the second flow regulators 12. All of the modular embodiments described above may also be configured so that cool coal is not mixed with the warm coal. With this configuration, the coal intake tubing 10, splitter 11, and second flow regulators 12 are eliminated, and the "cooling augers" 8 are more properly described as "conveyance devices."

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An apparatus for upgrading coal comprising:
(a) a baffle tower;
(b) an inlet plenum;
(c) an exhaust plenum; and
(d) one or more conveyance devices;
wherein the baffle tower comprises one or more side walls;
wherein each side wall has an outer face;
wherein a portion of the coal enters the baffle tower;
wherein the baffle tower comprises a plurality of alternating rows of inverted v-shaped inlet baffles and inverted v-shaped outlet baffles;
wherein all of the rows of inlet baffles are parallel to one another, and all of the rows of outlet baffles are parallel to one another;
wherein the rows of inlet baffles are perpendicular to the rows of outlet baffles;
wherein the inlet plenum is affixed to the outer face of one of the side walls of the baffle tower;
wherein the exhaust plenum is affixed to the outer face of one of the side walls of the baffle tower;
wherein process gas enters the baffle tower from the inlet plenum via baffle holes in one of the side walls of the baffle tower;
wherein the process gas that enters the baffle tower from the inlet plenum dries the coal that enters the baffle tower and becomes process exhaust gas;
wherein the process exhaust gas exits the baffle tower into the exhaust plenum via baffle holes in one of the other side walls of the baffle tower; and
wherein the coal that enters the baffle tower descends by gravity downward through the baffle tower and enters a conveyance device.

2. An apparatus for upgrading coal comprising:
at least two segmented units, each segmented unit comprising a processor segment, an inlet plenum, and an exhaust plenum;
wherein the processor segment comprises a plurality of alternating rows of inverted v-shaped inlet baffles and inverted v-shaped outlet baffles;
wherein all of the rows of inlet baffles are parallel to one another, and all of the rows of outlet baffles are parallel to one another;
wherein the rows of inlet baffles are perpendicular to the rows of outlet baffles;
wherein the inlet plenum is connected to an outer face of a first side wall of the processor segment;
wherein the exhaust plenum is connected to an outer face of a second side wall of the processor segment;
wherein process gas enters the processor segment from the inlet plenum via baffle holes in the first side wall of the processor segment;
wherein the process gas that enters the processor segment from the inlet plenum dries coal that enters the processor segment and becomes exhaust gas;
wherein the exhaust gas exits the processor segment into the exhaust plenum, via baffle holes in the second side wall of the processor segment; and
wherein the coal that enters the processor segment descends by gravity downward through the processor segment.

3. The apparatus of claim 2, wherein the segmented units are stacked vertically, and wherein there is a top segmented unit and a bottom segmented unit.

4. The apparatus of claim 3, wherein process gas enters through the inlet plenum of the top segmented unit and exhaust gas exits through the exhaust plenum of the top segmented unit.

5. The apparatus of claim 3, wherein process gas enters through the inlet plenum of the bottom segmented unit and exhaust gas exits through the exhaust plenum of the bottom segmented unit.

6. The apparatus of claim 3, wherein process gas enters through the inlet plenum of the top segmented unit and exhaust gas exits through the exhaust plenum of the bottom segmented unit.

7. The apparatus of claim 3, wherein process gas enters through the inlet plenum of the bottom segmented unit and exhaust gas exits through the exhaust plenum of the top segmented unit.

8. The apparatus of claim 3, wherein process gas enters through the inlet plenum of the top segmented unit and exhaust gas exits through multiple exhaust plenums.

9. The apparatus of claim 3, wherein process gas enters through the inlet plenum of the bottom segmented unit and exhaust gas exits through multiple exhaust plenums.

10. The apparatus of claim 3, wherein the inlet plenum of the top segmented unit comprises a plenum segment expansion joint and a spool connector, and wherein the inlet plenum is connected to the first side wall of the processor segment of the top segmented unit with a plenum-to-processor expansion joint.

11. The apparatus of claim 3, wherein the exhaust plenum of the top segmented unit comprises a plenum segment expansion joint and a spool connector, and wherein the exhaust plenum is connected to the second side wall of the processor segment of the top segmented unit with a plenum-to-processor expansion joint.

12. The apparatus of claim 3, wherein the inlet plenum of the top segmented unit has a depth, and the inlet plenum of the bottom segmented unit has a depth, and wherein the depth of the inlet plenum of the top segmented unit is greater than the depth of the inlet plenum of the bottom segmented unit.

13. The apparatus of claim 3, wherein the exhaust plenum of the top segmented unit has a depth, and the exhaust plenum of the bottom segmented unit has a depth, and wherein the depth of the exhaust plenum of the top segmented unit is greater than the depth of the exhaust plenum of the bottom segmented unit.

14. The apparatus of claim 2, wherein the inlet plenum has a cross-sectional flow area, wherein process gas flows into the inlet plenum at an inlet plenum gas flow rate, and wherein the cross-sectional flow area of the inlet plenum is proportional to the inlet plenum gas flow rate.

15. The apparatus of claim 2, wherein the exhaust plenum has a cross-sectional flow area, wherein exhaust gas flows into the exhaust plenum at an exhaust plenum gas flow rate, and wherein the cross-sectional flow area of the exhaust plenum is proportional to the exhaust plenum gas flow rate.

16. The apparatus of claim 2, wherein the processor segment of the top segmented unit comprises a processor segment expansion joint that connects the processor segment of the top segmented unit to a processor segment of a segmented unit directly beneath the top segmented unit.

17. The apparatus of claim 16, wherein the processor segment expansion joint comprises a particulate retainer and a flexible gas-tight seal.

* * * * *